US006916249B2

(12) United States Patent
Meade

(10) Patent No.: US 6,916,249 B2
(45) Date of Patent: Jul. 12, 2005

(54) INFANT SWING

(75) Inventor: James P. Meade, Hamburg, NY (US)

(73) Assignee: Mattel, Inc., El Segundo, CA (US)

( * ) Notice: Subject to any disclaimer, the term of this patent is extended or adjusted under 35 U.S.C. 154(b) by 61 days.

(21) Appl. No.: 10/390,714

(22) Filed: Mar. 19, 2003

(65) Prior Publication Data

US 2003/0181249 A1 Sep. 25, 2003

Related U.S. Application Data

(63) Continuation of application No. 09/971,567, filed on Oct. 9, 2001, now Pat. No. 6,561,915.

(51) Int. Cl.[7] ..... A63G 9/16
(52) U.S. Cl. ..... 472/119; 5/109
(58) Field of Search ..... 472/118–125; 5/105, 108, 109

(56) References Cited

U.S. PATENT DOCUMENTS

| | | | |
|---|---|---|---|
| 38,028 | A | 3/1863 | Brown |
| 303,875 | A | 8/1884 | Mason |
| 363,503 | A | 5/1887 | Bell |
| 664,322 | A | 12/1900 | Jacobs |
| 865,829 | A | 9/1907 | Unger |
| 961,311 | A | 6/1910 | Nelson |
| 1,056,337 | A | 3/1913 | Hurlbut |
| 1,107,341 | A | 8/1914 | Oldfield |
| 1,265,682 | A | 5/1918 | Larsen |
| 1,318,024 | A | 10/1919 | Sundell |
| 1,418,318 | A | 6/1922 | Merifield |
| 1,557,636 | A | 10/1925 | Warner |
| 1,727,635 | A | 9/1929 | Crane |
| 2,024,855 | A | 12/1935 | Goetter |
| 2,282,881 | A | 5/1942 | Ostrow |
| 2,402,861 | A | 6/1946 | Winnick |
| 2,628,666 | A | 2/1953 | Hall |
| 2,672,182 | A | 3/1954 | Gwin et al. |
| 2,726,838 | A | 12/1955 | Ripley, Jr. |
| 2,762,161 | A | 9/1956 | Danielson |
| 2,935,122 | A | 5/1960 | Miller |
| 3,069,202 | A | 12/1962 | Gotfried et al. |
| 3,101,972 | A | 8/1963 | Laughlin |
| 3,143,374 | A | 8/1964 | Carboni |
| 3,204,367 | A | 9/1965 | Stubbmann |
| D206,117 | S | 11/1966 | Levy |
| 3,425,744 | A | 2/1969 | Spector et al. |
| 3,512,297 | A | 5/1970 | Malherbe et al. |
| 3,649,074 | A | 3/1972 | McDonald et al. |
| 3,722,883 | A | 3/1973 | O'Dowd |
| 3,729,037 | A | 4/1973 | Dare et al. |
| D228,268 | S | 9/1973 | Saint |
| D229,999 | S | 1/1974 | Blazey et al. |
| 3,842,450 | A | 10/1974 | Pad |
| 3,883,136 | A | 5/1975 | Kim |
| 4,022,510 | A | 5/1977 | Saint |
| 4,028,753 | A | 6/1977 | Rios |
| 4,038,588 | A | 7/1977 | Woolfson et al. |
| 4,047,755 | A | 9/1977 | McDonald et al. |

(Continued)

FOREIGN PATENT DOCUMENTS

| | | |
|---|---|---|
| EP | 0 286 321 A2 | 10/1988 |
| EP | 1 010 448 A2 | 6/2000 |
| GB | 631026 | 10/1949 |
| WO | WO 86/03108 | 6/1986 |
| WO | WO 00/10431 | 3/2000 |

OTHER PUBLICATIONS

Swing Play Tray by Grace, http://www.amazon.com/exec/obidos/ASIN/B00004DSA2/qid=1003 . . . / 002–6040586–421605, pp. 1–4.

(Continued)

*Primary Examiner*—Kien Nguyen
(74) *Attorney, Agent, or Firm*—Cooley Godward LLP

(57) ABSTRACT

An infant swing that may be parent activated or sound activated and a method of using the same are disclosed.

11 Claims, 19 Drawing Sheets

U.S. PATENT DOCUMENTS 4,065,175 A 12/1977 Perego
4,072,318 A 2/1978 Laune
D247,397 S 3/1978 Tsumita
4,084,849 A 4/1978 Ishida et al.
4,094,547 A 6/1978 Zampino et al.
4,123,078 A 10/1978 Murakami
4,150,820 A 4/1979 Bochmann
4,181,299 A 1/1980 Foster
4,188,745 A 2/1980 Harvey et al.
4,240,625 A 12/1980 Meeker
4,271,627 A 6/1981 Echterling
4,298,228 A 11/1981 Zampino et al.
4,312,507 A 1/1982 Smith et al.
4,321,768 A 3/1982 Engelhardt
4,323,233 A 4/1982 Gebhard
4,325,578 A 4/1982 Borucki
4,344,649 A 8/1982 Fleischer
4,448,410 A 5/1984 Kosoff
4,491,317 A 1/1985 Bansal
4,540,219 A 9/1985 Klinger
4,594,072 A 6/1986 Cowell
D284,679 S 7/1986 Livesey et al.
4,606,576 A 8/1986 Jones
4,616,824 A 10/1986 Quinlan, Jr. et al.
4,620,702 A 11/1986 Hemmeter
4,640,033 A 2/1987 Bulger
4,667,358 A 5/1987 Penterman
4,681,096 A * 7/1987 Cuervo ..... 601/60
4,693,512 A 9/1987 Hobson
4,697,845 A 10/1987 Kamman
4,722,521 A 2/1988 Hyde et al.
4,775,184 A 10/1988 Larkin
4,785,678 A 11/1988 McGugan et al.
D298,956 S 12/1988 Zinter-Chahin
4,805,902 A 2/1989 Casagrande
4,807,872 A 2/1989 Spilman et al.
4,822,033 A 4/1989 Kohus et al.
4,934,997 A * 6/1990 Skakas ..... 600/26
4,940,229 A 7/1990 Foster
5,022,384 A 6/1991 Freels et al.
5,065,078 A 11/1991 Nao et al.
5,071,149 A 12/1991 Perego
5,088,138 A * 2/1992 Munster ..... 5/109
5,103,511 A 4/1992 Sequin
5,107,555 A * 4/1992 Thrasher ..... 5/109
D326,123 S 5/1992 Connon
D328,624 S 8/1992 Hu
5,162,038 A 11/1992 Wilker
D333,060 S 2/1993 Perego
5,183,457 A 2/1993 Gatts et al.
5,205,579 A 4/1993 Kato et al.
5,238,291 A 8/1993 Alionis
D339,001 S 9/1993 Schiffman
D339,772 S 9/1993 Hu
5,254,007 A 10/1993 Eagan
5,294,172 A 3/1994 Dubus
5,326,327 A 7/1994 Stephens et al.
5,348,368 A 9/1994 Garcia et al.
5,361,437 A 11/1994 Zhu et al.
5,376,053 A 12/1994 Ponder et al.
5,378,196 A 1/1995 Pinch et al.
D356,531 S 3/1995 Valenti
5,413,399 A 5/1995 Myers et al.
5,469,132 A 11/1995 Lam
D364,896 S 12/1995 Wu
5,473,307 A 12/1995 Lam
D368,816 S 4/1996 Mitchell et al.
5,518,475 A 5/1996 Garland
5,525,113 A 6/1996 Mitchell et al.
5,531,656 A 7/1996 Varghese
5,538,432 A 7/1996 Dondero et al.
5,547,256 A 8/1996 D'Antuono et al.
5,558,391 A 9/1996 Chavous
5,562,548 A 10/1996 Pinch et al.
5,574,339 A * 11/1996 Kattwinkel et al. ..... 318/10
D376,393 S 12/1996 Stroud et al.
5,586,800 A 12/1996 Triplett
5,588,164 A 12/1996 Proulx
5,593,207 A 1/1997 Turner
5,628,689 A 5/1997 Saint et al.
D383,338 S 9/1997 Gibbs
5,662,378 A 9/1997 Carruth
5,669,664 A 9/1997 Perego
5,709,582 A 1/1998 O'Donnell
D391,531 S 3/1998 Mak
5,769,727 A 6/1998 Fair et al.
5,781,939 A 7/1998 Bledsoe
5,791,999 A 8/1998 Lauro et al.
5,803,817 A 9/1998 Stern
5,806,113 A * 9/1998 McMahan et al. ..... 5/109
5,810,432 A 9/1998 Haut et al.
5,823,329 A 10/1998 Roberts
5,823,876 A 10/1998 Unbehand
5,833,189 A 11/1998 Rossman et al.
5,833,545 A 11/1998 Pinch et al.
D402,931 S 12/1998 Huang
5,842,715 A 12/1998 Jones
5,846,136 A 12/1998 Wu
5,964,665 A 10/1999 Uemura
5,975,628 A 11/1999 Russell
5,975,631 A 11/1999 Fair et al.
5,984,791 A 11/1999 Fair et al.
6,010,410 A 1/2000 Lauro et al.
6,022,277 A 2/2000 Jankowski
6,024,648 A 2/2000 Shurtleff et al.
6,027,409 A 2/2000 Favorito et al.
6,059,667 A 5/2000 Pinch
6,068,339 A 5/2000 Linzalone
6,089,653 A 7/2000 Hotaling et al.
6,119,996 A 9/2000 Connery
6,139,399 A 10/2000 DeAngelis
6,149,489 A 11/2000 Johnson
6,183,002 B1 2/2001 Choi et al.
6,193,224 B1 2/2001 Dillner et al.
6,216,605 B1 4/2001 Chapman
6,224,450 B1 5/2001 Norton
6,247,994 B1 6/2001 DeAngelis et al.
6,254,490 B1 7/2001 Lawson et al.
D447,445 S 9/2001 Lu
6,283,870 B1 9/2001 Saint et al.
6,318,803 B1 11/2001 Garland
6,319,138 B1 11/2001 Fair et al.
6,339,304 B1 1/2002 Allison et al.
6,361,446 B2 3/2002 Lawson et al.
6,398,304 B1 6/2002 Chen et al.
6,471,597 B1 10/2002 Flannery et al.
6,561,915 B2 * 5/2003 Kelly et al. ..... 472/119

OTHER PUBLICATIONS

Stroller Snack & Activity Tray by Graco, http://www.amazon.com/exec/obidos/ASIN/B00004DSA/qid%3DI . . . / 002–6040586–421605, pp. 1–4.

Product advertisement for Kolcraft's "Lil' Swinger" infant swing, 1 page.

Product advertisement for Graco's "The Advantage" baby swing, 2 pages.

* cited by examiner

INFANT SWING

CROSS-REFERENCE TO RELATED APPLICATIONS

This application is a continuation application of application Ser. No. 09/971,567, filed Oct. 9, 2001, now U.S. Pat. No. 6,561,915, issued May 13, 2003, entitled "Infant Swing and Method of Using the Same," the entire content of which is hereby incorporated by reference.

BACKGROUND OF THE INVENTION

This invention relates generally to an infant swing, and in particular, to an infant swing that may be used to entertain and/or pacify an infant located in the swing.

Conventional infant swings may be used to pacify and relax infants. Sometimes parents or care givers place an upset infant in a swing to calm the infant. Often the infant is soothed by the continuous oscillation of the swing. Conventional swings oscillate until turned off by the parent or care giver.

Sometimes parents or care givers place an infant in a swing in order to entertain the infant. Many conventional swings lack entertainment devices and as a result, the infants become bored quickly.

Some conventional infant swings are open top swings that, as a result of their open structure, facilitate the placement of an infant in and the removal of an infant from the swing. Some conventional swings include mechanisms that retain the seat back of a seat in several reclined positions. Many of these mechanisms are difficult to adjust, particularly when an infant is located in the seat.

A need exists for an infant swing that is automatically controlled based on sounds detected from the infant, and thus does not continuously oscillate unnecessarily. A need exists for an infant swing that provides an entertainment device that will entertain an infant located in the swing. A need exists for an infant swing that includes a seat back recline mechanism that may be easily adjusted to change the inclination of the seat.

SUMMARY OF THE INVENTION

Generally, the embodiments of the invention disclose an infant swing that may be used to pacify and/or entertain an infant. In one embodiment, the infant swing includes a sound detection circuit that may be used to detect sounds generated by an infant in the swing and to control the drive mechanism of the infant swing based on the detected sounds. In another embodiment, the infant swing includes an entertainment device that may be used with the infant swing to entertain an infant in the swing. In another embodiment, the infant swing includes an adjustment mechanism that may be used to adjust the angle of inclination of the seat. In another embodiment, the infant swing includes a control unit that utilizes pulse width modulation to control the drive mechanism imparting motion to the seat of the swing.

DETAILED DESCRIPTION OF THE INVENTION

An infant swing may be used to pacify and/or entertain an infant. In the illustrated embodiment, the infant swing includes a frame, a seat, and a drive mechanism. In one embodiment, the infant swing includes an adjustment mechanism that may be used to adjust the angle of inclination of the seat. The adjustment mechanism is coupled to the seat and can secure the seat in a particular position. The adjustment mechanism may be disposed in several positions to facilitate the reclining of the seat to make it more comfortable for the infant.

In one embodiment, the infant swing includes a drive mechanism and sound activation mechanism that may be used to control the operation of the drive mechanism based on any detected sounds. The sound activation mechanism includes an audio input detector or a sound detection circuit that can detect audible inputs and sounds. The sound detection circuit includes a sensitivity level selector that may be adjusted to determine the level of sound that can activate the sound activation mechanism. In another embodiment, the infant swing includes a control unit that utilizes pulse width modulation to control the drive mechanism.

In one embodiment, the infant swing includes an entertainment device that may be used with the infant swing to entertainment an infant in the swing. The entertainment device includes an electronic circuit that generates outputs to entertain the infant. The outputs include audio outputs, such as music and sound effects, and visual outputs, such as lights. The entertainment device may be releasably coupled to the infant swing.

Figure 1:
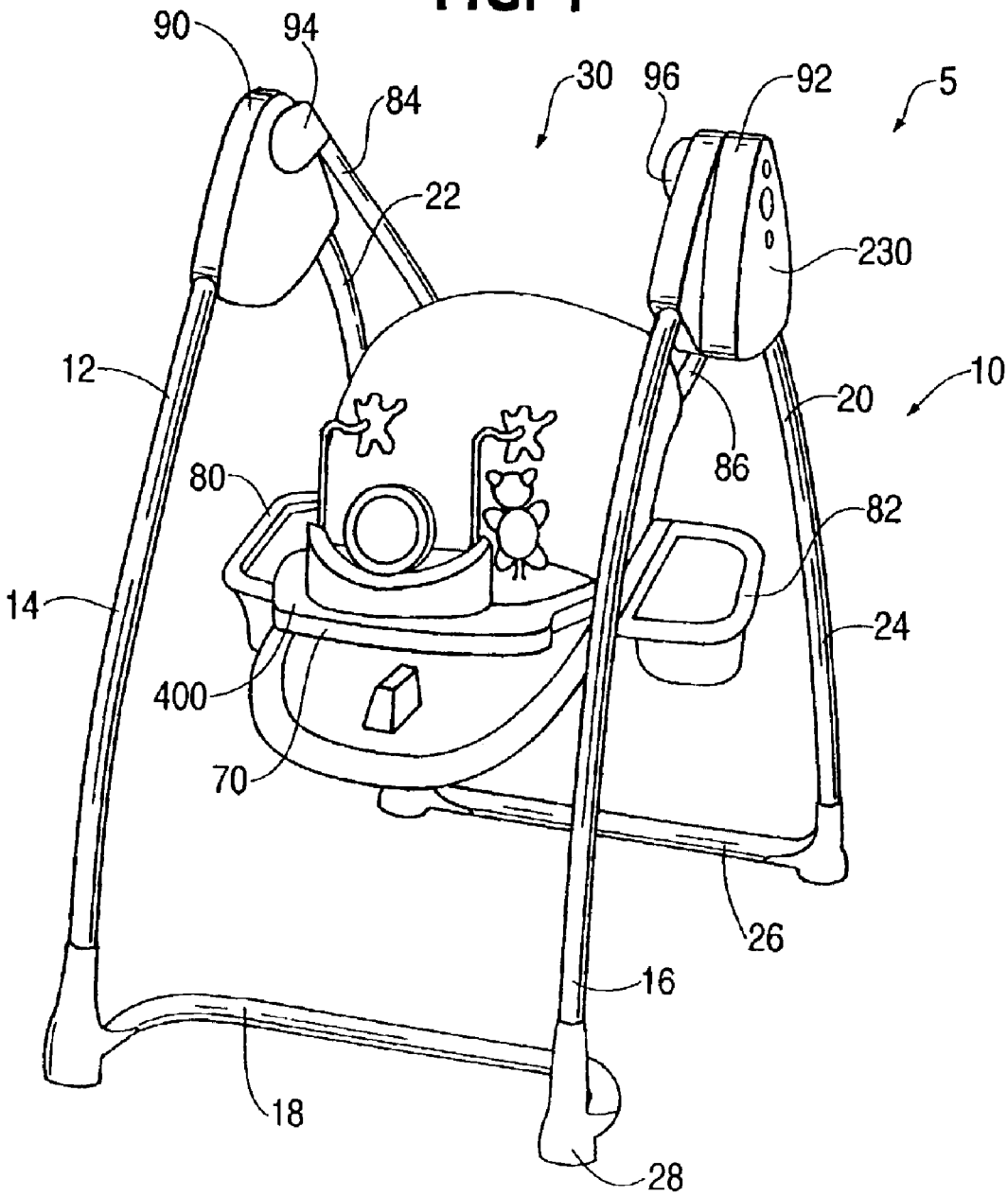
FIG. 1 illustrates a perspective view of an infant swing according to an embodiment of the invention.

An infant swing according to an embodiment of the invention is illustrated in FIG. 1. In the illustrated embodiment, the infant swing 5 includes a frame or support 10 and a seat 30 coupled to the frame 10.

The frame 10 includes a front frame 12 and a rear frame 20. As illustrated in FIG. 1, front frame 12 includes front legs 14 and 16 and a front base 18 coupled to the lower end of each of the front legs 14 and 16. Similarly, rear frame 20 includes rear legs 22 and 24 and a rear base 26 coupled to the lower end of each of the rear legs 22 and 24. The front base 18 and the rear base 26 include a pair of stabilizing feet 28 that provide support to the swing 5.

In the illustrated embodiment, the frame 10 includes housings 90 and 92. Front legs 14 and 16 are fixedly coupled to housings 90 and 92, respectively. Rear legs 22 and 24 are pivotally coupled to housings 90 and 92, respectively, and are movable between a deployed position, as illustrated in FIG. 1, and a collapsed position. In an alternative embodiment, the front legs 14 and 16 are pivotally coupled to housings 90 and 92 and rear legs 22 and 24 are fixedly coupled to housings 90 and 92. Front legs and rear legs are coupled to the housings 90 and 92 using any conventional mechanism, such as snap tabs or rivets.

In the illustrated embodiment, housing 92 contains a drive mechanism (discussed in detail below) that imparts motion to the seat 30. Housing 92 may also be referred to as a drive housing. In this embodiment, housing 90 does not include any drive mechanism components and may be referred to as an idler housing.

In the illustrated embodiment, the infant swing 5 includes hubs 94 and 96 and hanger arms 84 and 86 coupled to the hubs 94 and 96. The hubs 94 and 96 are pivotally coupled to housings 90 and 92, respectively. The drive mechanism in drive housing 92 causes hub 96 to reciprocate, which moves the components directly and indirectly connected to hub 96.

In the illustrated embodiment, seat 30 is coupled to hanger arms 84 and 86. While the illustrated embodiment includes two hanger arms, the swing may include a single hanger arm in an alternative embodiment.

In the illustrated embodiment, the swing 5 includes a retaining member 70 coupled to the seat 30. Retaining member 70 may be any type of support, such as a tray.

In one embodiment, the infant swing 5 includes baskets or bins 80 and 82 mounted on the sides of the seat 30. Each basket 80 and 82 includes a rim and a mesh net. Articles may be stored in the baskets 80 and 82. As the seat 30 swings back and forth, the baskets 80 and 82 contact the front frame 12 and the rear frame 20, thereby limiting the range of movement of the seat 30. In particular, basket 80 engages front leg 14 and rear leg 22 and basket 82 engages front leg 16 and rear leg 24.

In an alternative embodiment, the infant swing 5 may include only a single basket. Also, the shapes or configurations of the baskets may vary depending on the size of the objects to be placed therein.

In the illustrated embodiment, the infant swing 5 includes an entertainment device 400. As illustrated in FIG. 1, the entertainment device 400 is coupled to the retaining member 70. The entertainment device 400 generates audio and visual outputs in response to activities of the infant in the seat 30.

Figure 2:
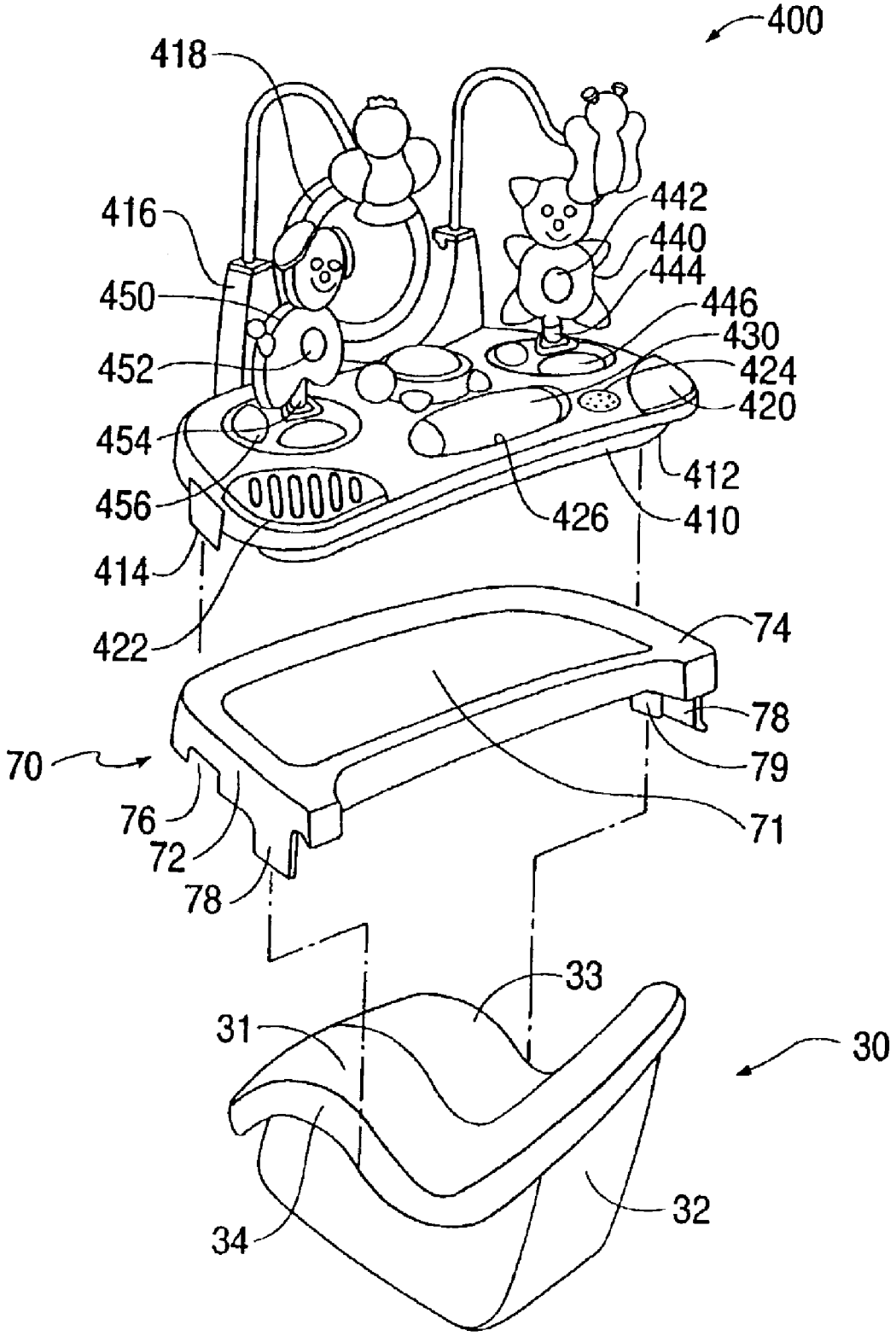
FIG. 2 illustrates an exploded perspective view of an embodiment of an entertainment device, tray, and seat embodying the principles of the invention.

A perspective view of an embodiment of a seat, a retaining member, and an entertainment device of the present invention is illustrated in FIG. 2. The operative relationship between the seat 30, the retaining member 70, and the entertainment device 400 is illustrated.

As illustrated in FIG. 2, the seat 30 includes a seat portion 31 and a back portion 32. Seat portion 31 and back portion 32 are integrally formed so that the seat 30 is a unitary piece. In an alternative embodiment, seat portion 31 and back portion 32 may be separate pieces that are pivotally coupled together. The seat 30 includes arm portions 33 and 34 along the sides of the seat portion 31.

In the illustrated embodiment, the retaining member 70 includes an upper support surface 71 and sides 72 and 74. Each side 72 and 74 includes a recess 76 and a flange 78 extending away from the support surface 71. The retaining member 70 also includes an extension 79 close to each side and depending from the lower surface of the retaining member 70. Each flange 78 and extension 79 combination engages one of the arm portions 33 and 34 on seat 30 and couples the retaining member 70 to the seat 30.

In the illustrated embodiment, the entertainment device 400 includes a housing 410 having a bottom portion 412. The entertainment device 400 includes an electronic circuit in the housing 410 that can generate audio outputs, such as music or sound effects, that are stored in a memory. The electronic circuit also generates visual outputs.

The bottom portion 412 is configured to conform to the contour of a recess in the support surface 71 of the retaining member 70. The housing 410 includes a resilient tab 414 coupled to each side of the housing 410. When the entertainment device 400 is coupled to the retaining member 70, each tab 414 engages one of the recesses 76. In order to separate the entertainment device 400 from the retaining member 70, the user pulls outwardly on the tabs 414 and lifts the housing 410 upwardly.

In the illustrated embodiment, the entertainment device 400 includes a support 416 mounted on the housing 410. The support 416 includes two recesses that are adapted to receive and retain two side posts extending from a mirror 418. The housing 410 includes several outputs, such as lights 420, 422, 446, and 456 and a speaker 424. The operation of the entertainment device 400 is discussed in more detail below.

The housing 410 includes a recess 426 formed in its upper surface. A roller 430 is rotatably mounted in the recess 426.

A switch is coupled to the roller 430. As an infant plays with the roller 430 and the roller 430 rotates, the switch is closed and audio and visual outputs are generated. For example, after the switch is closed, a particular song or songs are played and lights on the housing 410 are illuminated in a predetermined or random sequence.

The entertainment device 400 includes characters 440 and 450 supported by housing 410. In the illustrated embodiment, characters 440 and 450 represent different animals. Character 440 is mounted on a stem 444 that is snapped into an opening formed in the housing 410. Similarly, character 450 is mounted on a stem 454 that is snapped into an opening in housing 410.

In the illustrated embodiment, each character 440 and 450 includes an internal motion switch that detects movement of the character. The motion switch may be any conventional motion switch, such as a magnetic ball and ring switch. Each character 440 and 450 includes a light 442 and 452, respectively, that is illuminated in response to the closing of the corresponding internal motion switch.

In an alternative embodiment, the entertainment device may include any number of characters. Each of the characters may be coupled to the housing using any conventional connection that enables movement of the characters relative to the housing.

An embodiment of a seat adjustment mechanism embodying the principles of the invention is illustrated in FIGS. 3–11. In the illustrated embodiment, the infant swing 5 includes an adjustment mechanism 250 that may be used to adjust the angle at which the seat 30 reclines. The components of the adjustment mechanism 250 may be arranged to retain the seat 30 in several different positions. The seat 30 is illustrated in an upright position 252 in FIG. 3 and in a reclined position 254 in FIG. 4.

Figure 3:
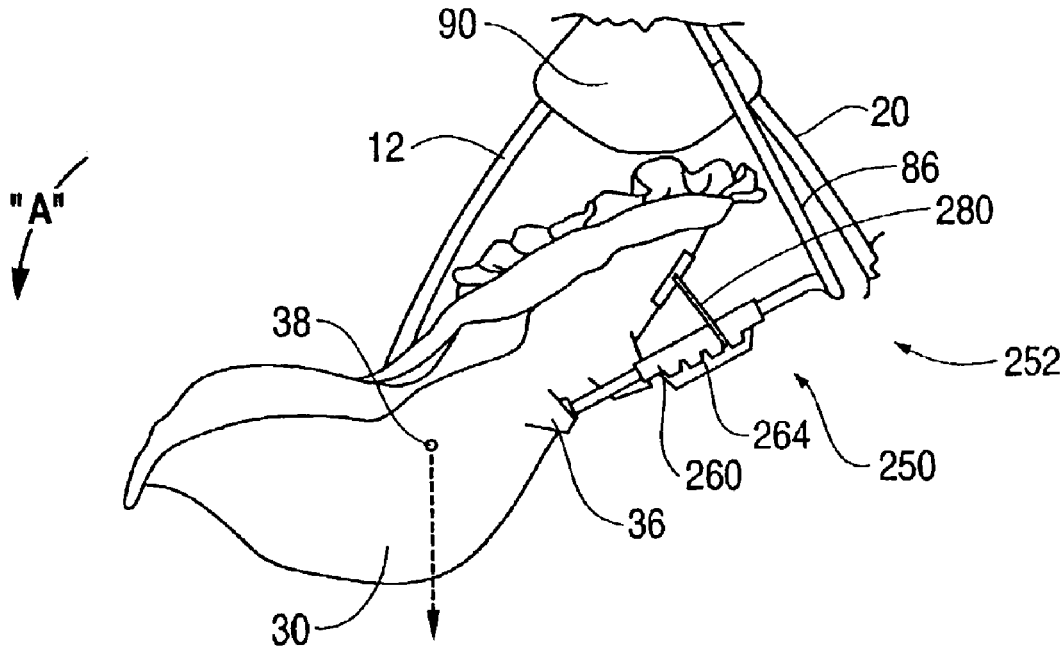
FIG. 3 illustrates a side view of an embodiment of a seat and an adjustment mechanism in an upright position.
Figure 4:
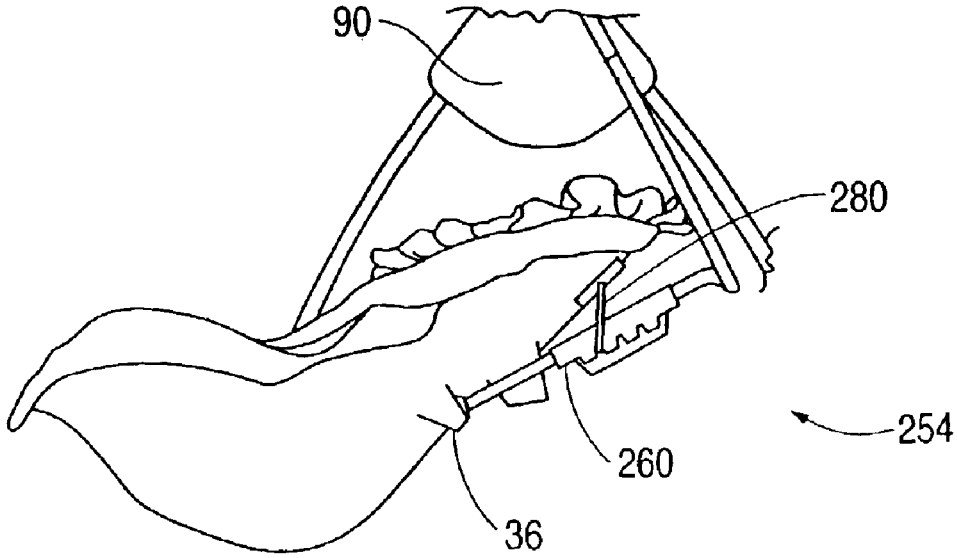
FIG. 4 illustrates a side view of an embodiment of the seat and adjustment mechanism of FIG. 3 in a reclined position.

Referring to FIG. 3, hanger arm 86 is connected to the seat 30 at pivot 36. Seat 30 can rotate relative to hanger arm 86 around pivot 36. In the illustrated embodiment, the approximate location of the center of gravity of the seat 30 (with or without an infant) is designated as reference numeral 38 in FIG. 3. Thus, the seat 30 has a tendency to rotate about pivot 36 along the direction of arrow "A".

In the illustrated embodiment, the adjustment mechanism 250 includes a housing 260 and an elongate member or connector 280. The housing 260 includes several recesses or engagement members 264. The housing 260 is coupled to the hanger arms 84 and 86, only one of which is visible in FIG. 3.

The elongate member 280 is pivotally coupled to the seat 30 and extends through the housing 260. Elongate member 280 may be positioned to engage any of the recesses 264. When the elongate member 280 engages a recess 264, the seat 30 is secured in a corresponding position with respect to hanger arm 86. In this embodiment, the elongate member 280 is in tension as it extends around the hanger arms 84 and 86. In an alternative embodiment, the housing may be disposed on the seat and the elongate member may be coupled to the hanger arms.

In order to adjust the seat 30, the user pushes the seat 30 rearwardly to disengage the elongate member 280 from the recesses 264 in the housing 260. To secure the position of the seat 30, the user allows the seat 30 to move forwardly when the elongate member 280 is aligned with one of the recesses 264 in the housing 260.

Figure 5:
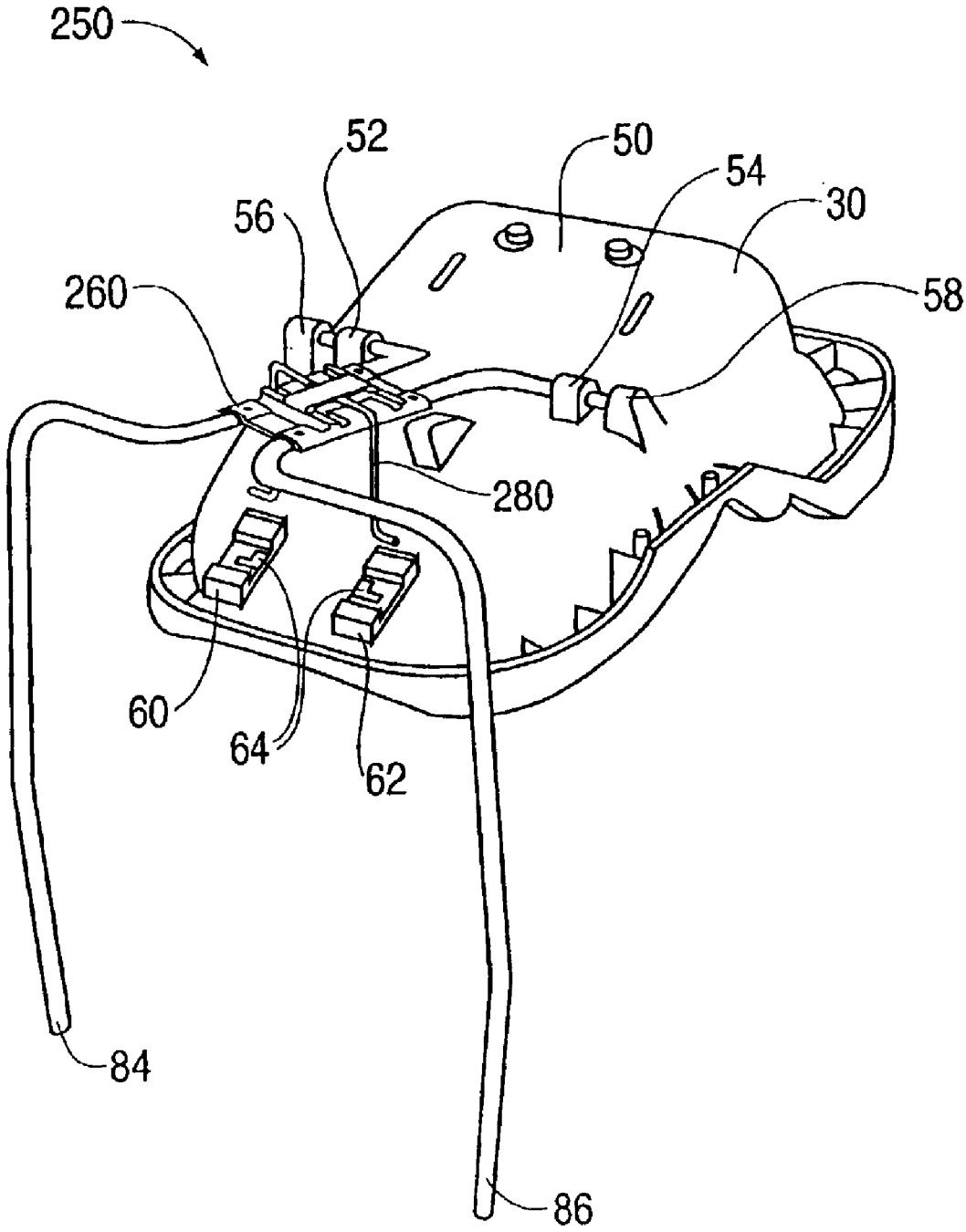
FIG. 5 illustrates a perspective view of the seat and adjustment mechanism of FIG. 3.
Figure 6:
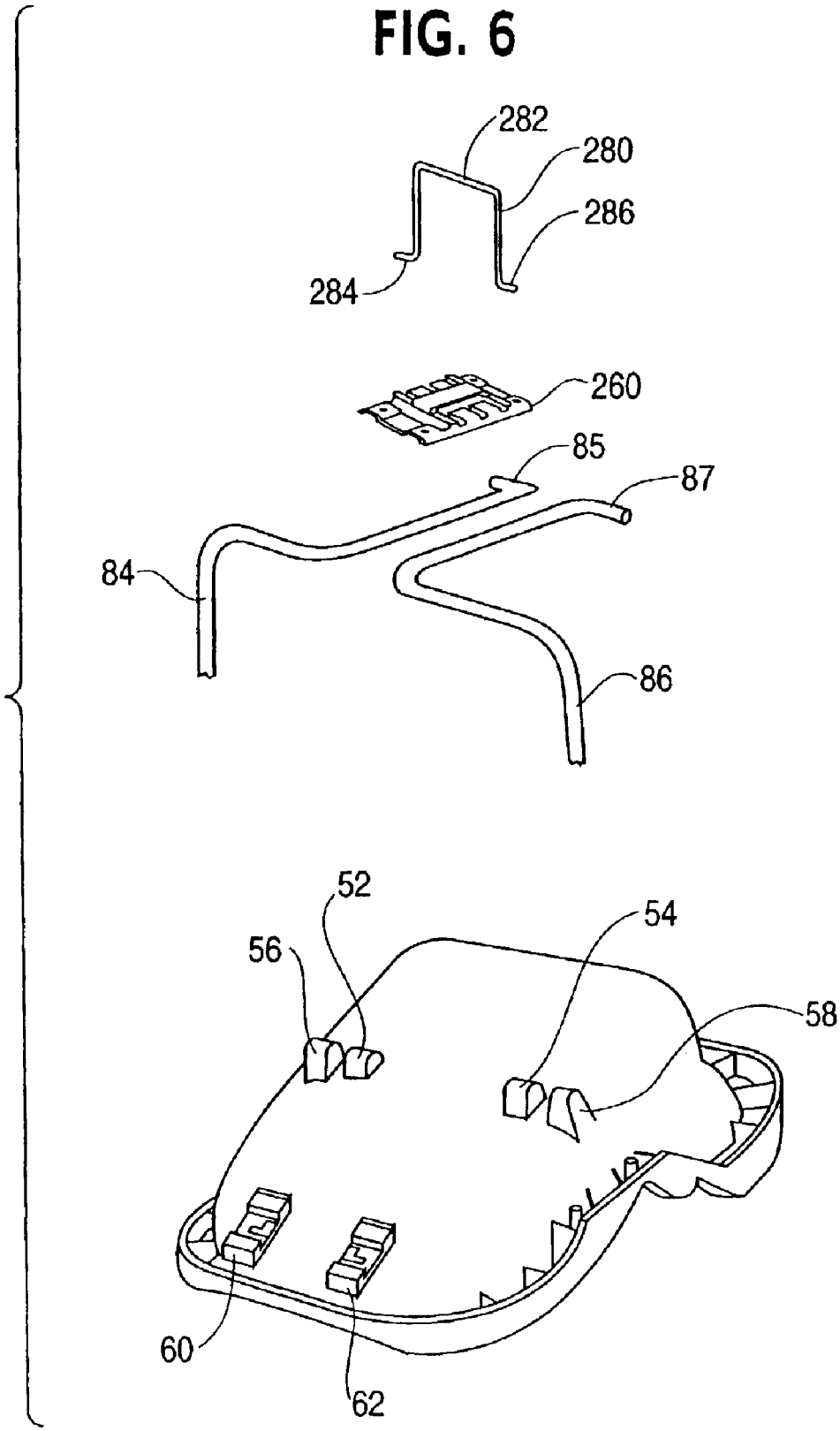
FIG. 6 illustrates an exploded perspective view of the seat and adjustment mechanism of FIG. 5.

Some of the components of the adjustment mechanism are illustrated in FIGS. 5 and 6. Referring to FIG. 5, seat 30 includes a lower surface 50 with collars 52 and 54 and sockets 56 and 58 extending therefrom. The seat 30 also includes mounting areas 60 and 62. Each mounting area 60 and 62 includes a slot 64 that extends through the back portion 32 to the front of the back portion 32.

As illustrated in FIG. 6, hanger arm 84 includes an end 85 and hanger arm 86 includes an end 87. End 85 is inserted through collar 52 and into socket 56. Similarly, end 87 is inserted through collar 54 and into socket 58. Housing 260 is coupled to the hanger arms 84 and 86 using conventional fasteners.

Figure 7:
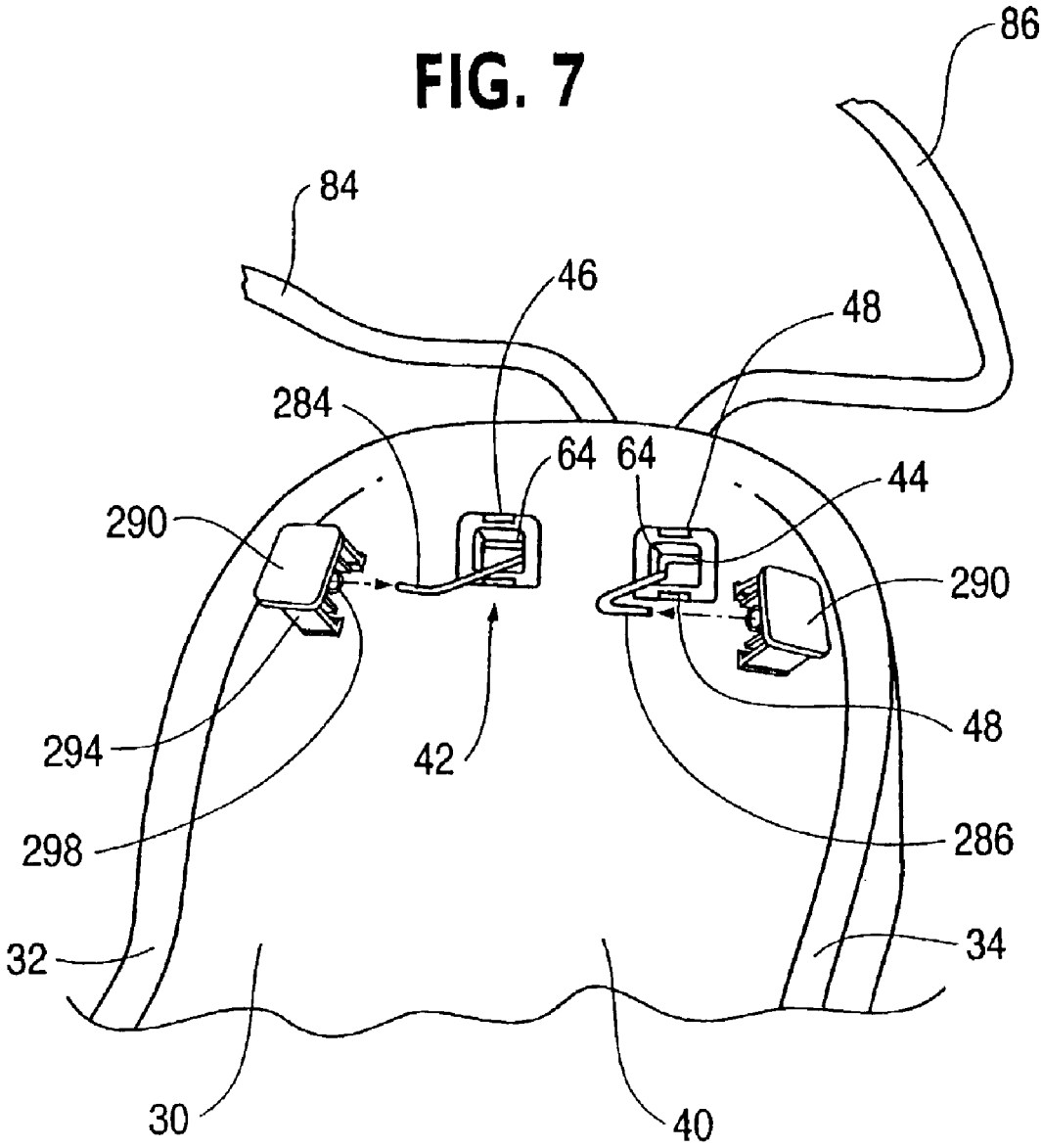
FIG. 7 illustrates a perspective view of some of the components of an embodiment of the adjustment mechanism of FIG. 5.

As illustrated in FIG. 7, the elongate member 280 is inserted through the housing 260 and is coupled to the seat back 32. In the illustrated embodiment, elongate member 280 is a wire-shaped member that is substantially U-shaped and includes a bight 282 and ends 284 and 286. The ends 284 and 286 of the elongate member 280 are inserted through the slots 64 in the mounting areas 60 and 62.

Figure 11:
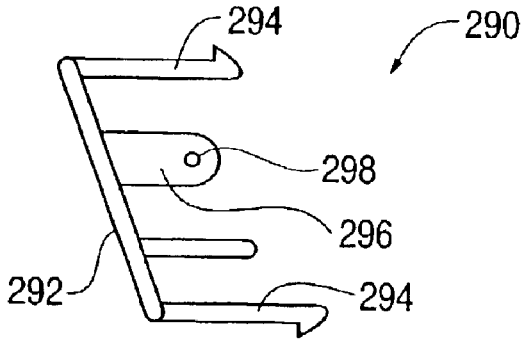
FIG. 11 illustrates a side view of an embodiment of a connector according to the principles of the invention.

In the illustrated embodiment, the adjustment mechanism 250 includes connectors 290 that are coupled to the seat 30 and the elongate members 280. As illustrated in FIG. 11, each connector 290 includes a plate 292 and snap tabs 294 coupled to the plate 292. The connector 290 includes an extension 296 coupled to the plate 292. The extension 296 includes a hole 298 through which an end of an elongate member 280 is inserted.

Referring to FIG. 7, after each connector 290 is mounted on an end 284 and 286 of the elongate member 280, the connectors 290 are aligned with the recesses 42 and 44 in the seat back 31. The snap tabs 294 are inserted into the slots 46 to connect the connectors 290 to the seat 30. The elongate member 280 is then pivotally coupled to the seat 30.

Figure 8:
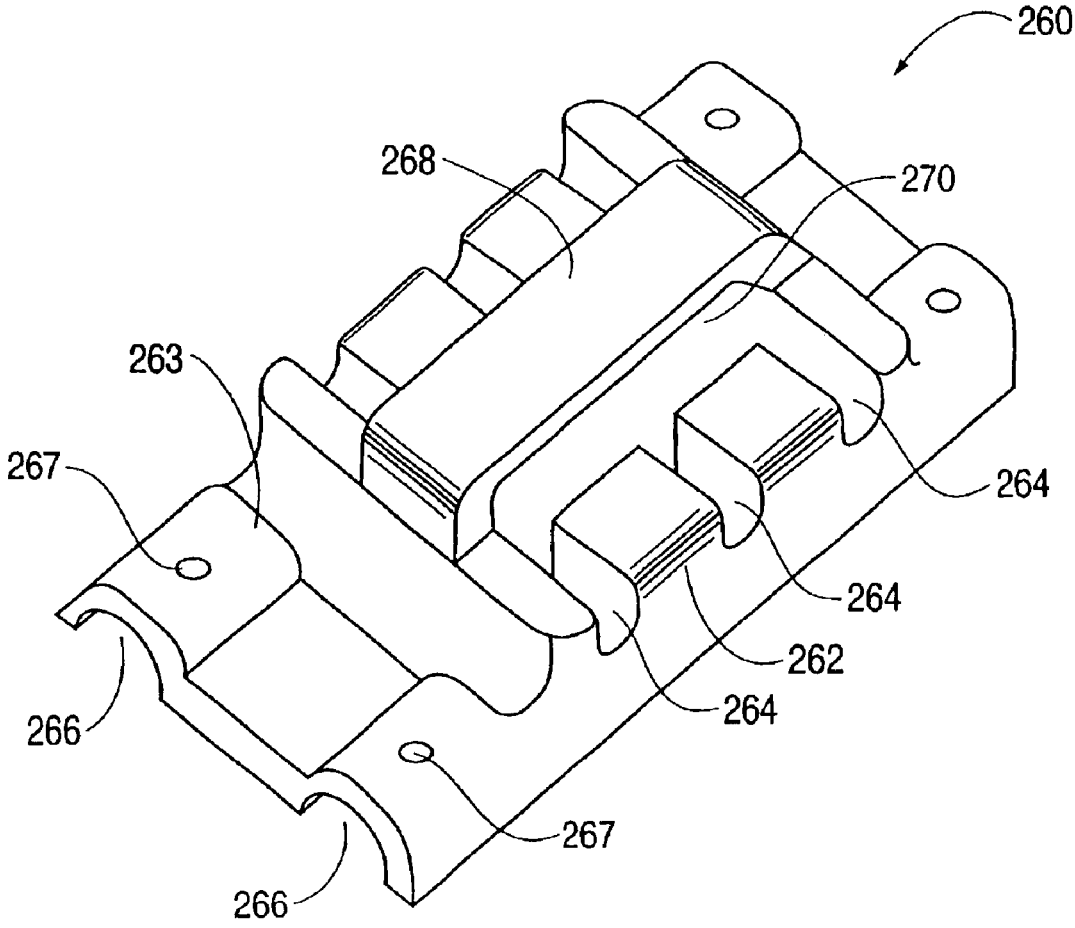
FIG. 8 illustrates a perspective view of a recline housing of the adjustment mechanism according to the principles of the invention.
Figure 9:
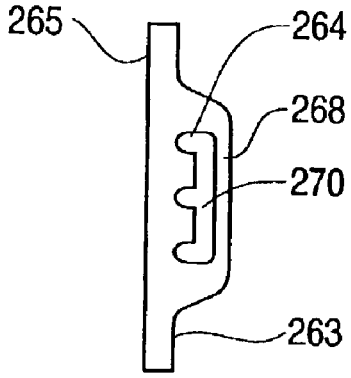
FIG. 9 illustrates a side view of the recline mechanism of FIG. 8.
Figure 10:
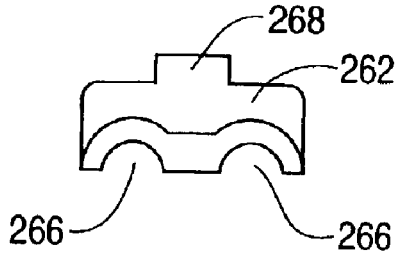
FIG. 10 illustrates an end view of the recline mechanism of FIG. 8.

An embodiment of a housing of an adjustment mechanism embodying the principles of the invention is illustrated in FIGS. 8–10. The housing may also be referred to as a position mechanism. The housing 260 includes a body 262 and a band 268 having two ends coupled to the body 262. The body 262 has an upper surface 263 and a lower surface 265. The housing 260 includes several mounting holes 267 through which fasteners (not illustrated) may be inserted to couple the housing 260 to the hanger arms 84 and 86.

Several sets of notches or recesses 264 are formed in the upper surface 263 of the housing 260. While the housing 260 is illustrated with three sets of recesses, the housing 260 may include any number of sets of recesses, depending on the quantity of recline positions desired.

In the illustrated embodiment, the band 268 is spaced apart from the upper surface 263 of the body 262. Band 268 and body 262 define a recess or channel 270 therebetween. The body 262 also includes channels 266 formed in its lower surface 265. Channels 266 have substantially the same shape or contour as that of the hanger arms 84 and 86, thereby facilitating the coupling of the housing to hanger arms 84 and 86.

Figure 12:
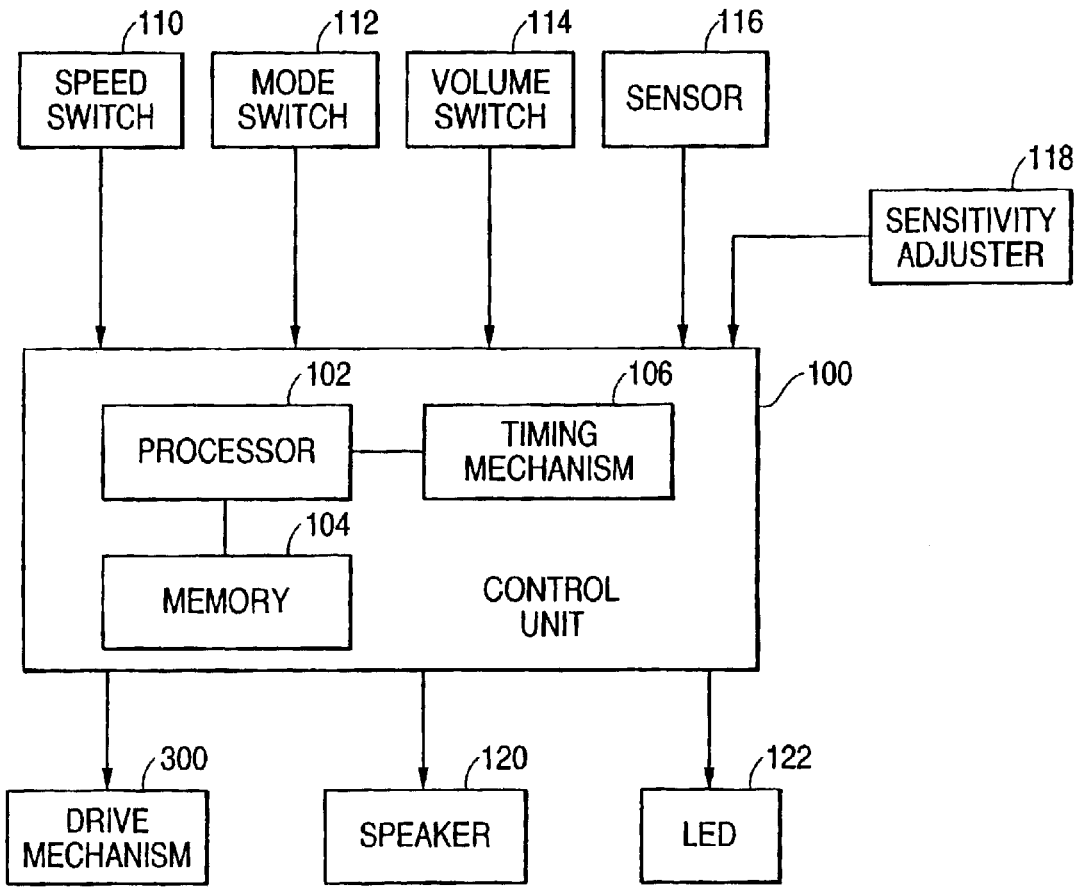
FIG. 12 illustrates a schematic view of some of the components of the electronic circuit of the infant swing.

An embodiment of some of the functional components of the infant swing is illustrated in FIG. 12. In the illustrated embodiment, the infant swing 5 has an electronic circuit that includes control unit 100 and several inputs and several outputs.

In the illustrated embodiment, the control unit 100 includes a processor 102, memory 104, and a timer or timing mechanism 106. The processor 102 may be any type of conventional processor, such as a conventional integrated circuit. The infant swing 5 also includes a power supply (not shown). While the timing mechanism 106 is illustrated as a separate from the processor 102, the processor may perform the timing functions described herein.

The memory 104 includes different types of pre-recorded audio outputs, such as songs and sound effects. The processor 102 can access data stored in the memory 104. The memory 104 may be any type of conventional memory, such as a disk drive, cartridge, or solid state memory. In the illustrated embodiment, audio outputs are pre-recorded and stored in memory 104.

The inputs to the electronic circuit include a speed switch 110, a mode switch 112, a volume switch 114, a sensor 116, and a sensitivity level selector or sensitivity adjuster 118, each of which is connected to the control unit 100. In the illustrated embodiment, these inputs are connected to the control unit 100 by wiring. The control unit 100 and wires form part of an electronic output generating circuit. In other embodiments, the inputs may be connected to the control unit 100 using any wired or wireless connections. For example, the infant swing may include an infra red, radio frequency, or ultrasonic receiver and transmitter, which may be used to control the infant swing remotely.

In the illustrated embodiment, the speed switch 110 is a multi-position switch that enables the user to select one of several operational speeds of the swing. The speed of the swing corresponds to the height, or amplitude, of the swing's oscillations. The speed switch 110 is a dial switch that has five positions. In alternative embodiments, the speed switch may include any number of positions.

In the illustrated embodiment, the volume switch 114 is a multi-position switch that enables the user to select the volume for audio outputs generated by the sound generating circuit. While the volume switch 114 has four positions, the switch may include any number of positions.

In the illustrated embodiment, the mode switch 112 is a multi-position switch that enables the user to select the mode of operation for the infant swing. The infant swing 5 can operate in several modes, including a standard mode, and a sonic or sound activation mode. In the standard mode, the infant swing 5 starts to oscillate when it is turned on and oscillates continuously until it is turned off. In the sonic or sound activation mode, the infant swing 5 starts to operate when the swing 5 detects a sound at a predetermined level. In this embodiment, the predetermined level corresponds to a predetermined level within a frequency range. In this mode, the swing oscillates until the end of a predetermined cycle, at which time the swing monitors for any appropriate sound to restart the swing oscillation. The operation of the infant swing in the sonic mode is described in detail below.

In the illustrated embodiment, the infant swing 5 includes a sensor 116. Sensor 116 is a sensor or detector, such as a microphone, that generates a signal in response to the detection of incoming sounds. Signals generated by the sensor 116 are analyzed by the electronic circuit.

In the illustrated embodiment, the infant swing 5 includes a sound sensitivity adjuster 118. Sound sensitivity adjuster 118 is electrically connected to the control unit 100. The sound sensitivity adjuster 118 is a rotatable mechanism that is connected to a potentiometer. The adjuster may be varied over a range from low sensitivity to high sensitivity. When the adjuster is at a low sensitivity, the sensor 116 listens or monitors for loud sounds. When the adjuster is at a high sensitivity, the sensor 116 listens only for soft sounds.

One of the outputs of the infant swing 5 is a speaker (or other suitable audio transducer) 120 through which the audio outputs may be played. The speaker 120 is connected to the control unit 100 via wiring. In the illustrated embodiment, the sound generating circuit continuously generates audio outputs while the swing is operating. The sound generating circuit plays the songs stored in memory on a continual, looping basis.

Another output of the infant swing 5 is an LED 122 that is illuminated when the infant swing is operating. The speaker 120 and the LED 122 are connected to the control unit 100. While the LED 122 is illustrated on housing 92 in FIG. 1, the LED 122 may be located anywhere on the swing 5.

In the illustrated embodiment, the infant swing 5 includes a drive mechanism 300 that is connected to the control unit 100. The drive mechanism 300 is coupled to the seat 30 and is controlled by the control unit 100.

Figure 13:
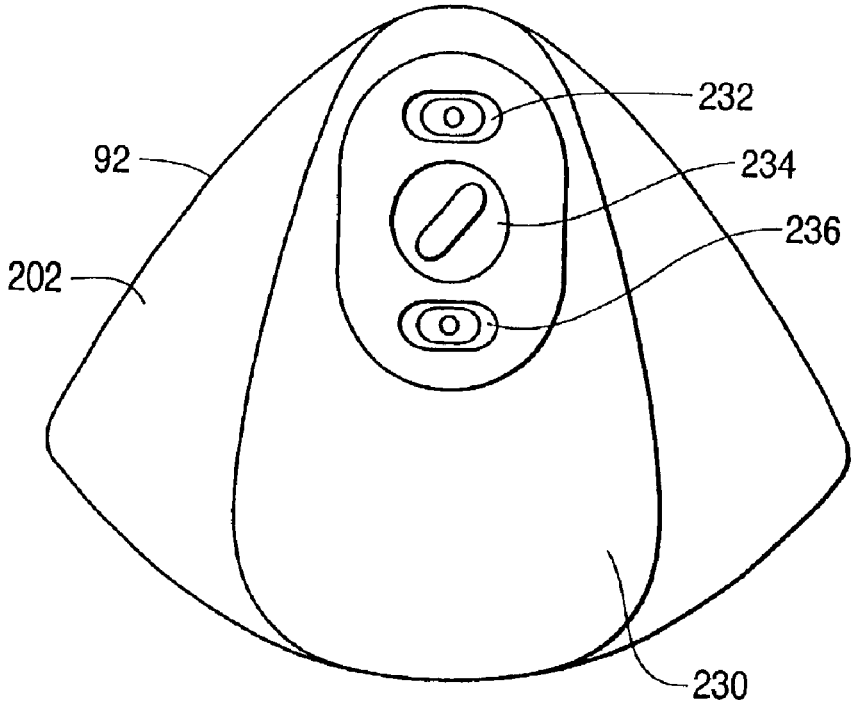
FIG. 13 illustrates a right side view of an embodiment of a drive housing of the infant swing according to the principles of the invention.
Figure 14:
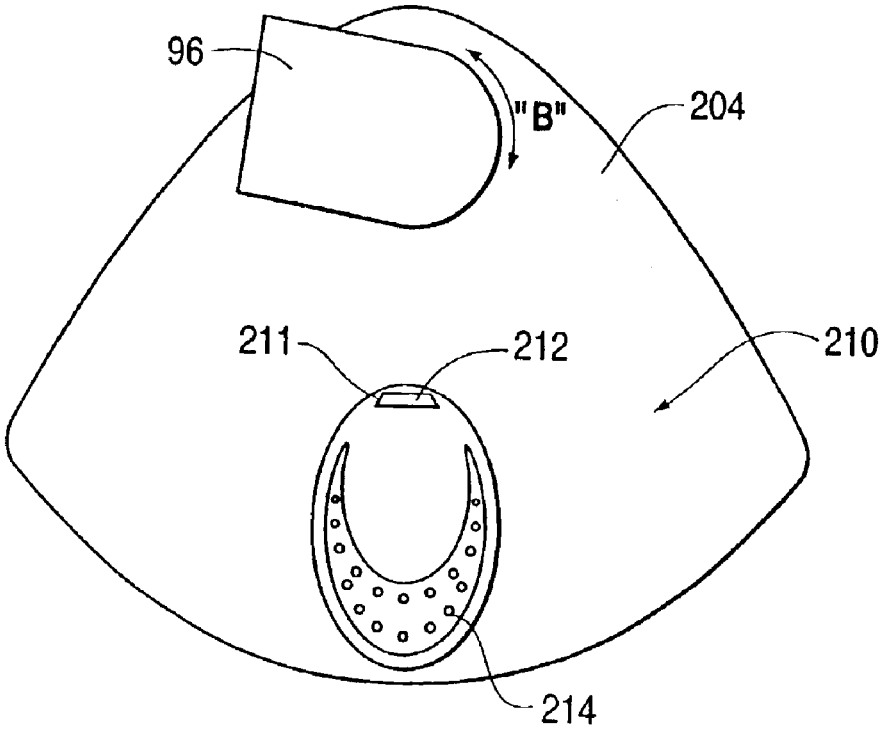
FIG. 14 illustrates a left side view of the drive housing of FIG. 13.

An embodiment of a drive housing embodying the principles of the invention is illustrated in FIGS. 13–14. In the illustrated embodiment, drive housing 90 includes an outer surface 202 facing away from the seat 30 and an inner surface 204 facing the seat 30. The drive housing 90 includes a control housing 230 mounted on outer surface 202. The control housing 230 includes a mode switch 232, a speed switch 234, and a volume switch 236. The positions and types of these switches may vary in alternative embodiments.

As illustrated in FIG. 14, drive housing 90 includes a sensor region 210. Sensor region 210 includes an opening 211 and a sound sensitivity adjuster 212 that is rotatably mounted in the opening 211. Sound sensitivity adjuster 212 is connected to a potentiometer (not illustrated) in the control unit 100 that varies the level at which sounds are detected. The sensitivity of the sensor is adjustable to vary the level at which sounds will trigger the sound activation system of the swing. While the illustrated sound sensitivity adjuster 212 is a rotatably mounted dial, any mechanism that permits a user to adjust a potentiometer or other level selection device may be used.

The sensor region 210 includes several openings 214 that extend through the inner surface 204 of the drive housing 90 to the inside of the housing 200. A sound detector, such as a microphone, is positioned within the housing 200 beneath the openings 214. The openings 214 are proximate to the seat 30 so that any sound generated by an infant in the seat 30 travels through the openings 214 to the sound detector. As illustrated in FIG. 14, a hub 96, to which a hanger arm is coupled, is coupled to the drive housing 90 for reciprocal movement along the direction of arrow "B".

In alternative embodiments, the detector or microphone may be mechanically and acoustically separated from the drive mechanism. For example, in one embodiment, the microphone may be located in the idler housing and the control unit and drive mechanism located in the drive housing. The microphone and the control unit may transmit and receive signals using any conventional wireless method. Alternatively, the microphone may be located on a cantilever beam or arm extending from the drive housing.

Figure 15:
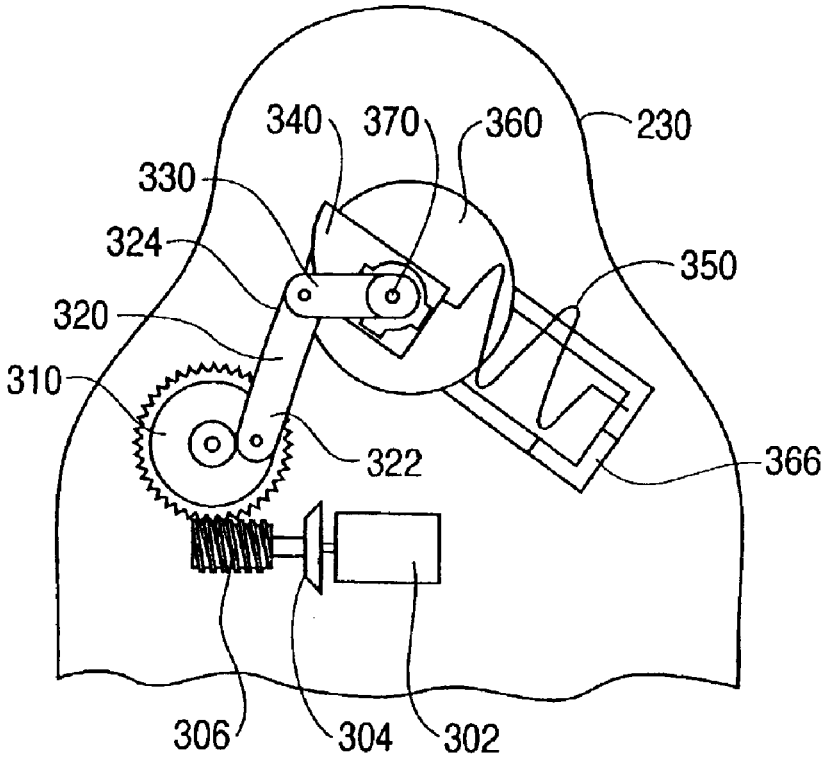
FIG. 15 illustrates a front view of an embodiment of a drive mechanism of the infant swing according to the principles of the invention.
Figure 16:
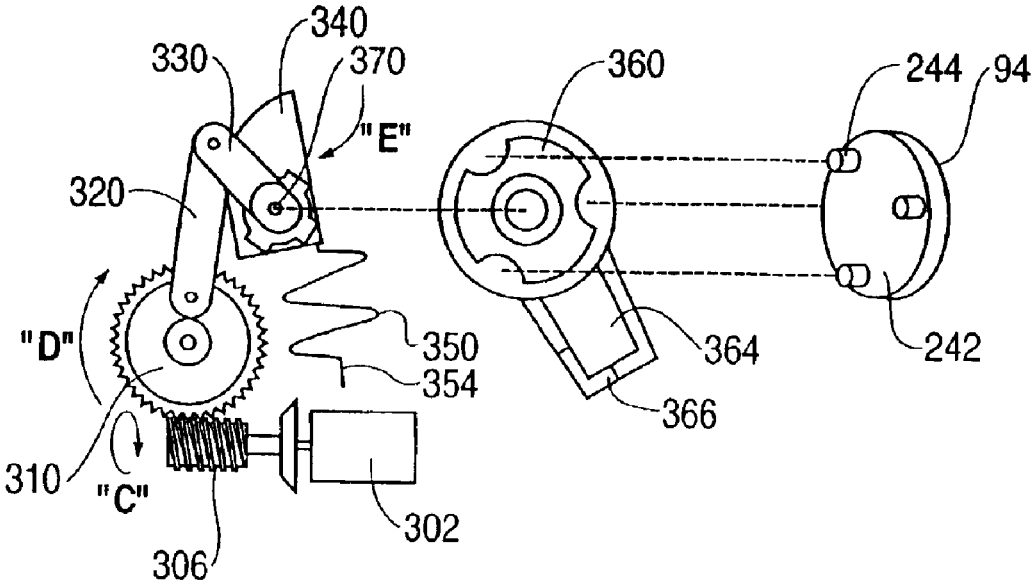
FIG. 16 illustrates an exploded front view of the drive mechanism of FIG. 15.
Figure 17:
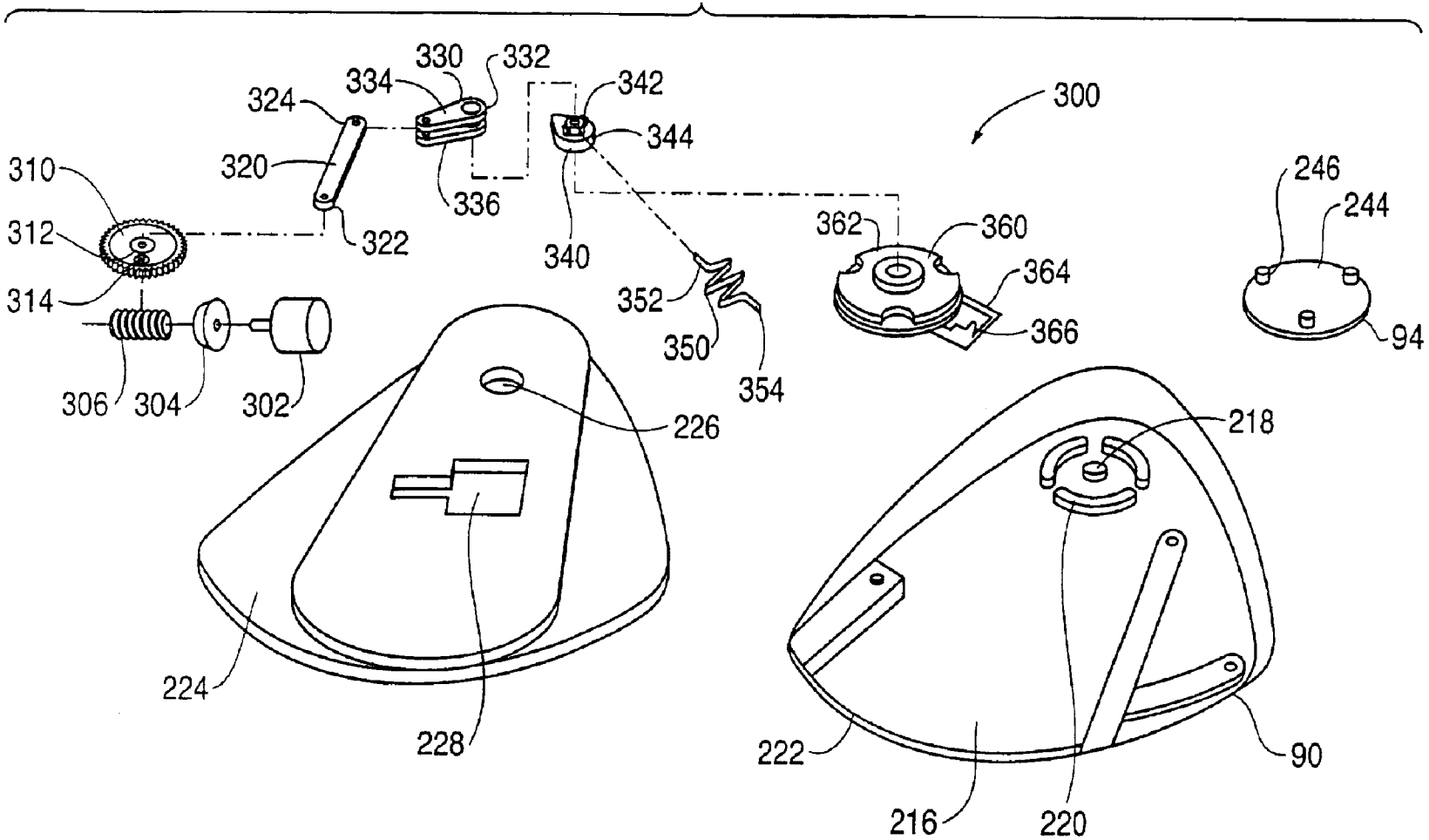
FIG. 17 illustrates an exploded perspective view of the components of the drive mechanism according to the principles of the invention.

An embodiment of a drive mechanism embodying the principles of the invention is illustrated in FIGS. 15–22. FIGS. 15 and 16 illustrate some components of the drive mechanism. FIG. 17 illustrates an exploded perspective view of the drive mechanism.

The drive mechanism 300 includes a drive housing 90 and a control housing 230 coupled to the drive housing 90. An outer cover (not illustrated) of the control housing 230 is removed in the view illustrated in FIGS. 15 and 17.

In the illustrated embodiment, the drive mechanism 300 includes a motor 302 with a plate 304 and a worm gear 306 mounted on the output shaft of the motor 302. As shown, the worm gear 306 has teeth that engage teeth along the outer circumference of a drive gear 310 that is mounted for rotation about a center shaft 312. As the worm gear 306 rotates along the direction of arrow "C" (see FIG. 16), the drive gear 310 rotates along the direction of arrow "D".

In the illustrated embodiment, the drive mechanism 300 includes a link 320 that is pivotally coupled to the drive gear 310. The link 320 includes a first end 322 and a second end 324. The first end 322 of link 320 is coupled to the drive gear 310. As drive gear 310 rotates, the first end 322 of the link 320 moves and motion is imparted to the second end 324 of the link 320.

In the illustrated embodiment, the drive mechanism 300 includes a link coupler 330. The link coupler 330 is mounted for rotation about pivot point 370 by a fastener or connector, which is connected to the housing 90. The link coupler 330 is pivotally coupled to the second end 324 of the link 320. As the link 320 moves, the link coupler 330 oscillates along the direction of arrow "E" about pivot point 370.

The drive mechanism 300 includes a drive coupler 340 that is pivotally connected to the link coupler 330. As the link coupler 330 oscillates, drive coupler 340 oscillates about pivot point 370 as well.

The drive mechanism 300 includes a resilient mechanism 350 that is connected to drive coupler 340. In the illustrated embodiment, the resilient mechanism 350 is a spring. When drive coupler 340 oscillates, the spring 350 oscillates about pivot point 370 simultaneously.

In the illustrated embodiment, the drive mechanism 300 includes a drive arm 360 that is pivotally mounted about pivot point 370. The drive arm 360 is engaged with hub 94 to impart motion to a hanger arm connected to the hub 94. When spring 350 oscillates, spring end 354 engages an extension 366 on the drive arm 360. In the illustrated embodiment, spring 350 is flexible, but has sufficient rigidity to cause the drive arm 360 to pivot. As the drive arm 360 oscillates, the hanger arm and the seat 30 oscillate.

Referring to FIG. 16, the drive arm 360 and the hub 94 are illustrated in an exploded relationship with respect to other components in the drive mechanism 300. A hanger arm is connected to the hub 94.

An exploded perspective view of the drive mechanism is illustrated in FIG. 17. The drive housing 90 includes an outer shell 222 and an inner shell 224. The outer shell 222 has an inner surface 216 that includes a drive aperture 218 and several arcuate slots 220. The inner shell 224 includes openings 226 and 228 into which some components of the drive mechanism 300 are positioned. The outer shell 222 and inner shell 224 are coupled together using any conventional mechanism, such as connectors or fasteners.

In the illustrated embodiment, the drive gear 310 includes a center post 312 and a connecting post 314. The link 320 has a first end 322 and a second end 324. The first end 322 of the link 320 is connected to the connecting post 314 by a connector.

Figure 18:
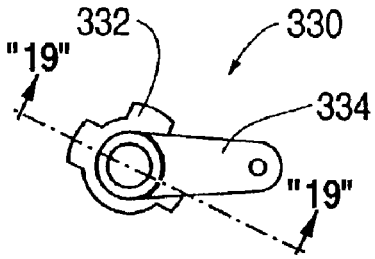
FIG. 18 illustrates a top view of a link coupler of the drive mechanism of FIG. 17.
Figure 19:
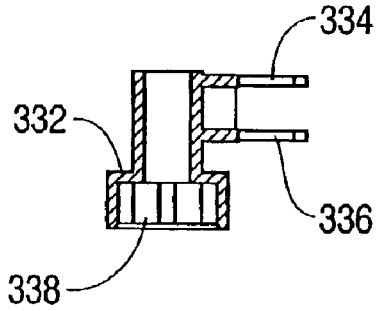
FIG. 19 illustrates a cross-sectional side view of the link coupler of FIG. 17 taken along the lines "19—19".
Figure 20:
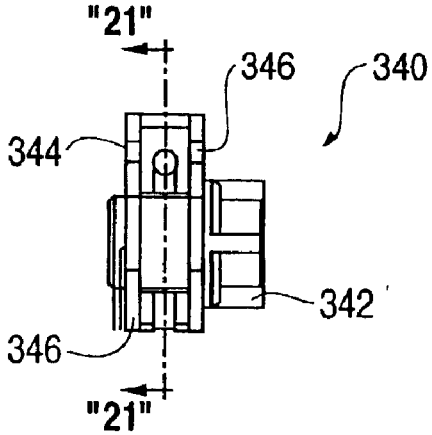
FIG. 20 illustrates a side view of a drive coupler of the drive mechanism of FIG. 17.

An embodiment of a link coupler embodying the principles of the invention is illustrated in FIGS. 18–20. The link coupler 330 has a body 332 and flanges 334 and 336 extending from then body 332. Flanges 334 and 336 are spaced apart a sufficient distance to enable the second end 324 of link 320 to be inserted therebetween. Link coupler 330 and link 320 are coupled using any conventional mechanism. The body 332 includes an internal socket 338 formed in the bottom surface of the body 332.

Figure 21:
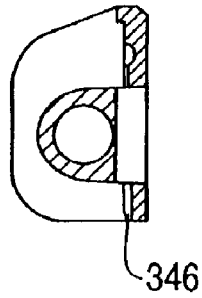
FIG. 21 illustrates a cross-sectional view of the drive coupler of FIG. 20 taken along lines "21—21".
Figure 22:
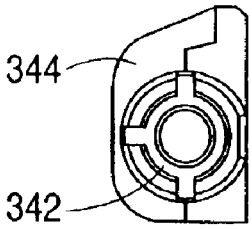
FIG. 22 illustrates an end view of the drive coupler of FIG. 20.

An embodiment of a drive coupler embodying the principles of the invention is illustrated in FIGS. 20–22. The drive mechanism 300 includes drive coupler 340 that is coupled to the link coupler 330. Drive coupler 340 includes a body 344 and a shaft 342 extending from the body 344. The configuration of the shaft 342 is substantially the same as the configuration of the socket 338 on the link coupler 330. When the shaft 342 is inserted into the socket 338 on the link coupler 330, the link coupler 330 and the drive coupler 340 are operably coupled together.

The body 344 of drive coupler 340 also includes a slot 346. End 352 of the biasing mechanism 350 is inserted into the slot 346 of drive coupler 340 and retained by a conventional fastener.

The drive mechanism 300 includes a drive arm 360, as illustrated in FIG. 17. Drive arm 360 includes a plate 362 and a flange 364. The plate 362 and the flange 364 are integrally formed. The flange 364 has a raised extension 366 disposed at one end. As the biasing mechanism 350 oscillates, spring end 354 engages extension 366 and drive the arm 360.

The drive mechanism 300 includes a hub 94 to which one of the hanger arms is coupled. The hub 94 includes an inner surface 242 that has shafts 244 which engage slots 220 in the outer shell 226. As the hub 94 oscillates, the shafts 244 travel back and forth along slots 220.

During operation, the motor 302 drives the drive gear 310, link 320, link coupler 330, drive coupler 340, spring 350, and arm 360. Torque is applied to the arm 360 when the seat 30 is at an apex of its rearward swinging motion. The drive mechanism 300 ramps up to the speed at which the speed switch is set. When a user adjusts the speed switch, the motion of the seat is updated to the new speed.

Figure 23:
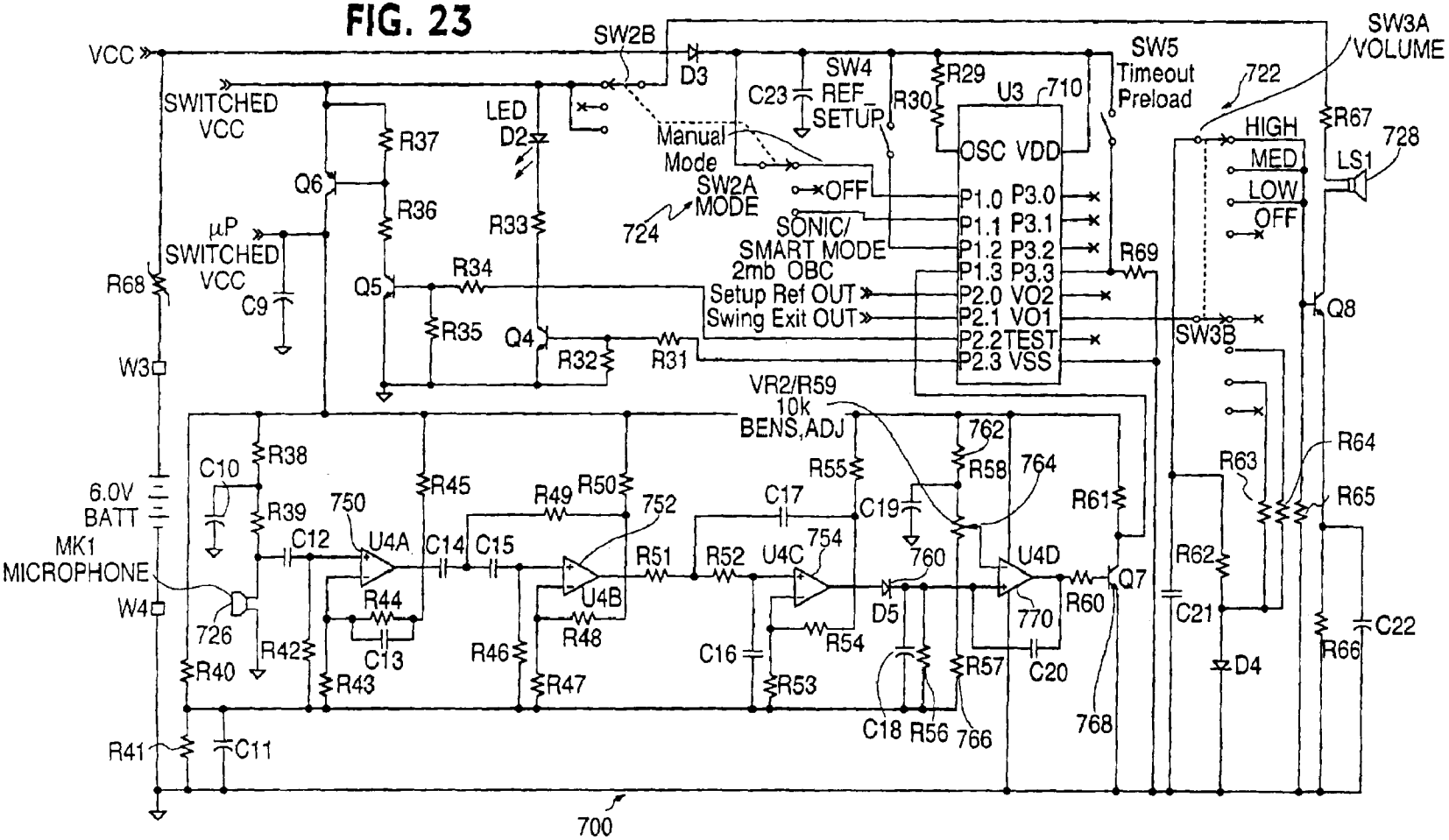
FIG. 23 illustrates a schematic diagram of a first part of an embodiment of an electronic circuit of the infant swing according to the principles of the invention.
Figure 24:
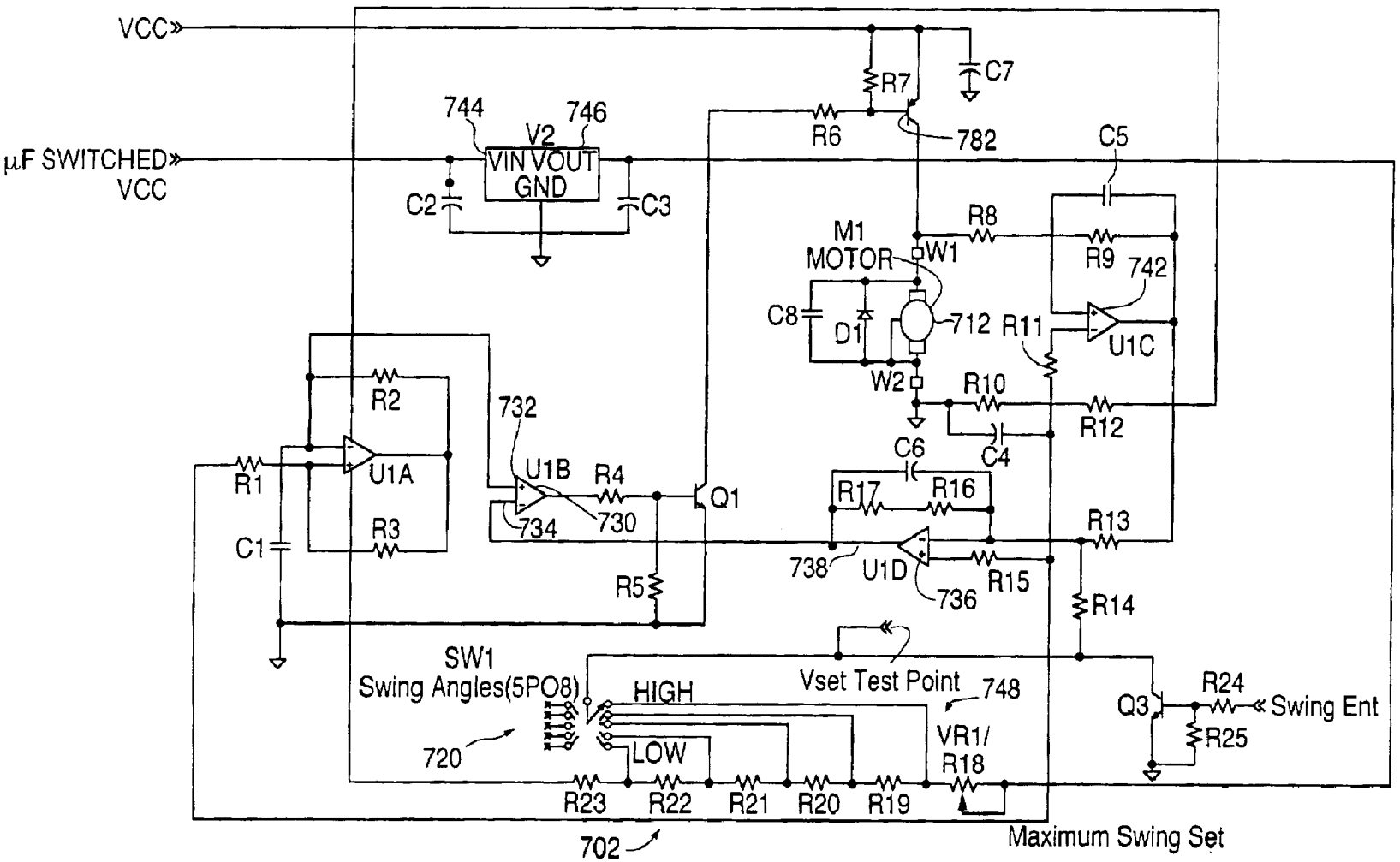
FIG. 24 illustrates a schematic diagram of a second part of an embodiment of an electronic circuit of the infant swing according to the principles of the invention.

An embodiment of the electronic circuit of the infant swing is illustrated in the schematic diagrams of FIGS. 23 and 24. Referring to FIG. 23, a portion 700 of the electronic circuit is illustrated. Referring to FIG. 24, the other portion 702 of the electronic circuit is illustrated.

In the illustrated embodiment, the control unit 100 of the infant swing 5 utilizes pulse width modulation to control the operation of the motor 302 of the drive mechanism 300. Pulse width modulation is a method of controlling the speed of the motor by applying a variable duty cycle square wave voltage to the motor. The motor speed may be changed by varying the voltage applied to the motor winding, and in particular, by varying the pulse-width ratio of the voltage. The pulse-width ratio is equal to the time period during which voltage is applied divided by the corresponding time period for a cycle of voltage application. Longer voltage pulses increase the pulse-width ratio and the motor turns faster. The result is a varying rectangular pulse width that exists above a threshold setting.

When the motor is turning, it acts as a generator and a voltage is induced in the stator windings of the motor. The voltage applied to the motor is greater than the induced voltage in order to provide torque-generating current. In effect, the motor generates its own voltage. The induced voltage is referred to as the back electromotive force (back EMF) of the motor. The use of the back EMF to determine the load on the motor eliminates the need for any external sensor to determine the position of the motor or the current swing angle or position of the seat.

In the illustrated embodiment, the motor operates in a voltage range of approximately 3 to 6 volts. The electronic drive system is designed around a reference voltage to keep the root mean squared (RMS) voltage within a particular range of the motor design specification. In this embodiment, the reference voltage is ½ VCC or approximately 3.0 volts. Initially, when the motor is stationary, no back EMF is generated. When the motor speed increases, the voltage generated by the motor and the back EMF increase. When the motor speed decreases, the voltage generated by the motor and the back EMF decrease. The back EMF may be used to determine the speed of the motor.

In the illustrated embodiment, an exponential rise and fall wave form centered around ½ VCC is received at node 732 (see FIG. 24). This wave form creates a psuedo triangle that is fed into node 732 of reference comparator 730. The comparator reference voltage at node 734 is a composite value of the loaded motor voltage's back EMF and the initial speed setting voltage established by the regulator 746 and the resistor divider string 748.

The loaded back EMF voltage of the motor 712 is sensed or determined by the differential ground referenced amplifier 740. As the load on the motor 712 increases during operation, the differential output voltage at node 742 increases. The voltage at node 742 and the swing angle/speed setting voltage are added together. Any increase in the summed voltage causes the output voltage at node 738 of amplifier 736 to become more negative, which, in turn, lowers the threshold reference voltage at node 734 of reference comparator 730. As the reference voltage at node 734 is lowered, the width or duration of the pulses of voltage supplied to the motor 712 increases and more voltage is supplied to the motor 712. The net effect of an increase in the load on the motor 712 is an overall increase in the voltage supplied to the motor. Since the system is a closed loop system, a decrease in the load on the motor 712 causes an overall decrease in the voltage supplied to the motor.

In the illustrated embodiment, the electronic circuit 700 and 702 includes a controller or processor 710 and several inputs. The illustrated circuit includes a mode switch 724 that may be used to select the mode of operation of the infant swing 5. The mode switch 724 may be set to a manual mode or a sonic/smart mode. The circuit includes a volume switch 722 that may be used to set the volume at which music or sound effects are played through transducer or speaker 728. The circuit also includes a speed switch 720 (see FIG. 24) that may be used to select the swing angle or height at which the swing oscillates.

In the illustrated embodiment, the circuit includes a microphone 726 that may be used to detect sounds generated by an infant. The circuit includes a microphone gain stage 750, the output of which is filtered by band pass filters 752 and 754 to form a response in the range of 800 Hz to 4 kHz. This filtering allows the reduction of a voice band to affect the response of the detection circuitry. Since the range of an infant's cries is approximately 2 kHz to 3 kHz, the energy is centered inside of the selected range. The filtered response is one-half wave rectified to a direct current voltage by rectifier 760. The rectified response is directed to a user adjustable comparator 770.

If the amplitude of the infant's cries creates a direct current voltage value greater than the user adjustable setting value established by resistors 762, 764, and 766, the comparator 770 will toggle to a logic low for the duration that the sonic value exceeds the user adjusted value. An inverter 768 functions as a voltage level shifter that inverts the logic.

The processor 710 analyzes the logic change from the inverter 768 and identifies any logic change to low that lasts longer than a predetermined time. In the illustrated embodiment, the predetermined time is approximately 1.5 seconds.

A logic change from inverter 768 is representative or indicative of an infant's cry above a predetermined amplitude level within a frequency range. If the sonic filtered audio indicative of an infant's cry persists for at least 1.5 seconds, the swing enable line toggles low, thereby allowing the pulse width modulation circuitry to turn on the motor 712 for a predetermined duration. In the illustrated embodiment, the predetermined duration that the motor 712 is turned on is approximately 20 minutes. At the end of this duration, the swing enable line toggles to a logic high, thereby turning off the swing motor drive.

If a sound that meets a predetermined level is detected with a particular time period, such as three hours, the swing 5 will restart playing music and the motor drive is turned on. If no sonic input is detected within that time period, the processor 710 goes into a low current sleep mode and turns off all motor drive circuitry.

Figure 25:
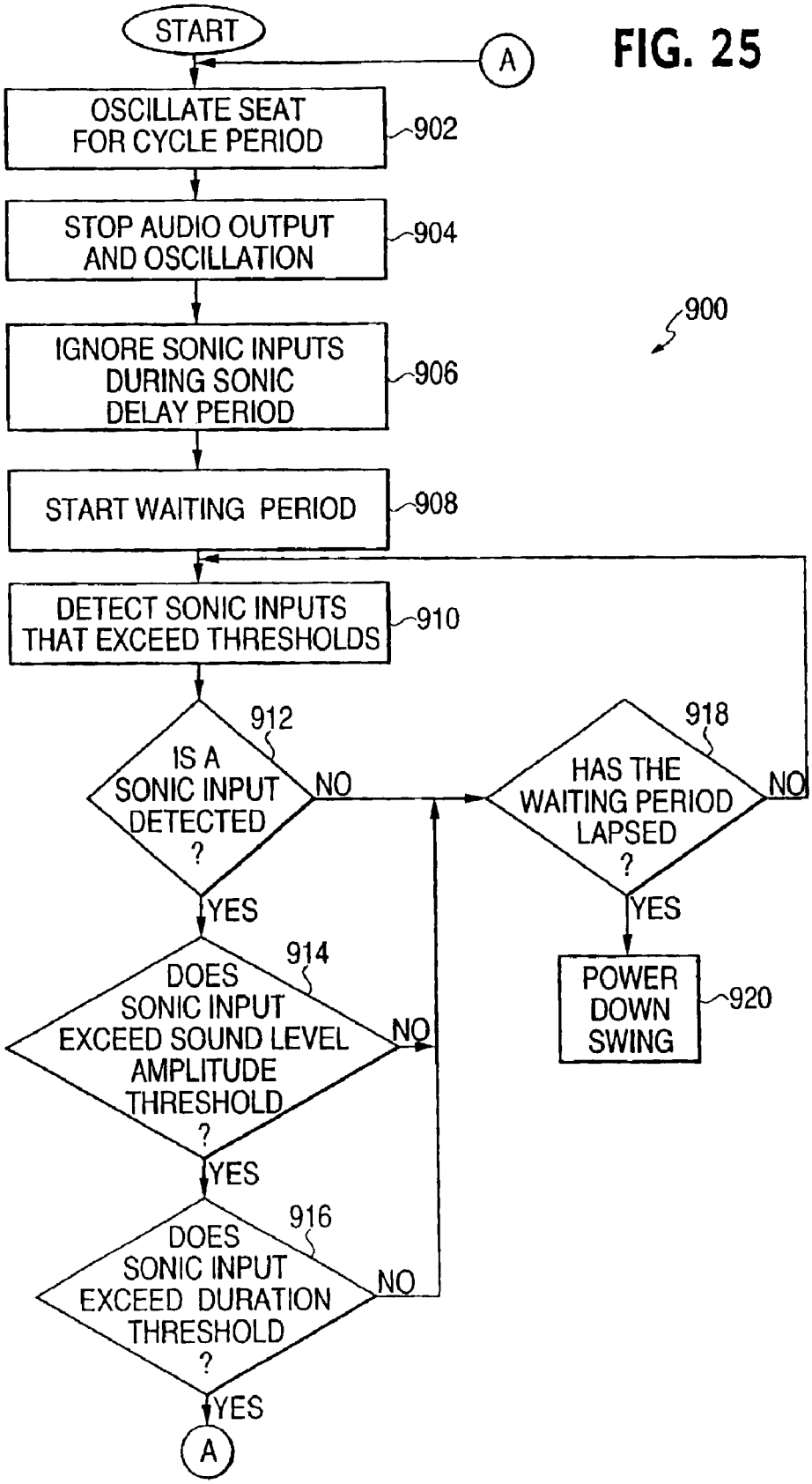
FIG. 25 illustrates a flowchart of a method of operating the infant swing according to the principles of the invention.

An operation of the infant swing 5 is now described. FIG. 25 illustrates a flowchart 900 including some of the steps of the operation of the infant swing 5 in the sonic/smart activation mode. Other combinations of steps may be carried out when the swing is in this mode.

Initially, the user turns on the infant swing 5 using the mode switch. In this scenario, the user moves the mode switch to the smart or sonic activation mode. At the same time, the user can select the particular level at which the swing oscillates by adjusting the speed switch.

At step 902, the drive mechanism oscillates the seat 30 of the swing 5 for a cycle period, as determined by the processor. In the illustrated embodiment, the cycle period is twenty minutes. During the cycle period, the LED is illuminated and an audio output, such as music, is played through a speaker on one of the housings of the swing.

At step 904, after the cycle period has elapsed, the control unit 100 stops the audio output and the drive mechanism stops oscillating the seat.

At step 906, the control unit 100 ignores all sonic inputs during a sonic delay period. In the illustrated embodiment, the sonic delay period is between 0.5 and 8 seconds, and in one embodiment, the sonic delay period is approximately 1.5 seconds. By ignoring any sonic input during this period, false start-ups of the swing based on mechanical noise, such as the slowing down of the swing drive mechanism after operation, are eliminated.

At step 908, the control unit 100 starts a waiting period. In the illustrated embodiment, the waiting period is approximately 3 hours. The waiting period is the period during which the swing 5 is in a stand-by mode as it awaits a sonic input. In one embodiment, the control unit 100 causes the LED to flash during the last portion of the waiting period, such as the last thirty minutes.

At step 910, after the sonic delay period has elapsed, the sonic detection components that listen or monitor for any sonic inputs that meet a predetermined sound level amplitude threshold are activated. The control unit 100 or processor 710 monitors all sonic logic levels that appear at P1.3 on the processor 710 (see FIG. 23). As discussed above, the electronic circuit utilizes a logic change in response to a signal representative of an audio input. In the illustrated embodiment, the sonic delay period is shorter than the time period of the total decay of swinging motion.

At step 912, the control unit 100 determines whether a sonic input is detected at P1.3. If a sonic input is detected, the process continues to step 914. Otherwise, the process continues to step 918.

At step 914, the control unit 100 determines whether the detected sonic input exceeds the predetermined sound level amplitude threshold. The sound level threshold may be set by the user via the sound sensitivity adjuster. If the sonic input exceeds the predetermined threshold, the process continues to step 916. Otherwise, the process continues to step 918.

At step 916, the control unit 100 determines whether the detected sonic input exceeds the duration threshold. The duration threshold is set by the control unit 100. The control unit 100 analyzes the signal generated as a result of the detected sonic input to determine the duration of the sonic input. If the sonic input exceeds the predetermined duration, then the detected sonic input meets the requirements for an input that causes the restarting of the oscillation of the seat 30, and the process returns to step 902. Otherwise, the process continues to step 918.

At step 918, the control unit 100 determines whether the waiting period has lapsed. If the waiting period has elapsed at step 918, the process continues to step 920. Otherwise, the process continues to step 910, and the control unit 100 monitors for any other sonic inputs during the waiting period.

At step 920, the control unit 100 and the drive mechanism power down.

Figure 26:
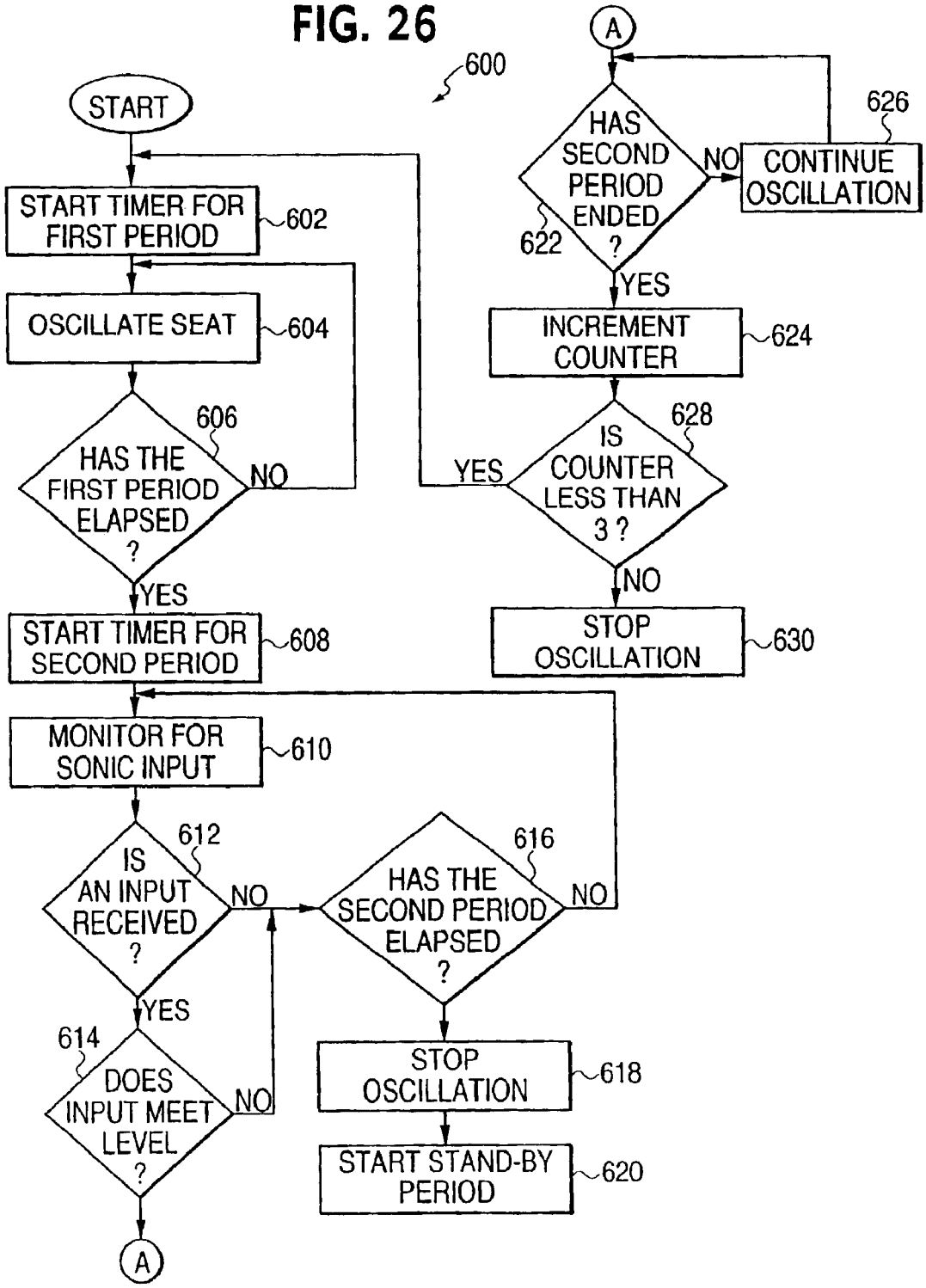
FIG. 26 illustrates a flowchart of an alternative method of operating the infant swing according to the principles of the invention.

An alternative operation of the infant swing 5 is now described. FIG. 26 illustrates a flowchart 600 including some of the steps of the operation of the infant swing 5 in the sonic/smart activation mode. Other combinations of steps may be carried out when the swing is in this mode.

Initially, the user turns on the infant swing 5 using the mode switch. In this scenario, the user moves the mode switch to the sonic activation mode. At the same time, the user can select the particular level at which the swing oscillates by adjusting the speed switch.

At step 602, the processor in the control unit starts a timer, which is used to determine the expiration of a first period.

Once the swing 5 is turned on, power is supplied to the drive mechanism 300 to oscillate the swing seat 30, as in step 604. The drive mechanism 300 continually increases the oscillation of the seat 30 until the amplitude of oscillation reaches the level selected by the user via the speed switch.

At step 606, the seat 30 continues to oscillate until the processor determines that the first time period has elapsed. In this embodiment, the first is approximately seventeen minutes. If it has not, then the seat 30 continues to oscillate. If the first period has elapsed, the process continues to step 608.

At step 608, the processor starts the timer to monitor a second time period. In this embodiment, the second time period is three minutes.

At step 610, the control unit monitors for an audio input. In particular, the sound detecting circuit is activated to detect audio inputs. In the illustrated embodiment, the sound detecting circuit monitors for audio inputs during the second time period.

At step 612, the processor determines whether an audio input is received. If no input is received, then the process continues with step 616.

At step 614, if an audio input is received, the processor determines whether the input reaches a predetermined amplitude level within a frequency range or sound level threshold. If the input does not meet the predetermined level, then the process continues with step 616.

At step 616, the processor determines whether the second period has elapsed. If the second period elapsed and no input that reached the predetermined level was received, then the process continues to step 618.

At step 618, the oscillation of the seat 30 is stopped.

At step 620, the control unit remains in a stand-by or power down mode for a stand-by period.

If an input at or above the predetermined level is received at step 614, then the seat 30 continues to oscillate until the second period elapses. At step 622, the processor determines whether the second period has elapsed. If the second period has not elapsed, then the process continues to step 626.

At step 626, the seat 30 oscillates until the second period has ended.

Once the second period end, a counter in the control unit is incremented (see step 624). The process continues to step 628.

At step 628, the processor determines whether the cycle counter is less than a predetermined number. In this embodiment, the cycle counter is any mechanism that keeps track of the number of consecutive cycle periods that the seat has been oscillated. If the cycle counter is less than a predetermined number of cycles, such as three, the process returns to step 602 and another oscillation cycle is performed. Otherwise, the process continues to step 630 and the oscillation of the seat 30 is stopped. While the predetermined number of cycles described above is three, any number of oscillation cycles may be used.

Figure 27:
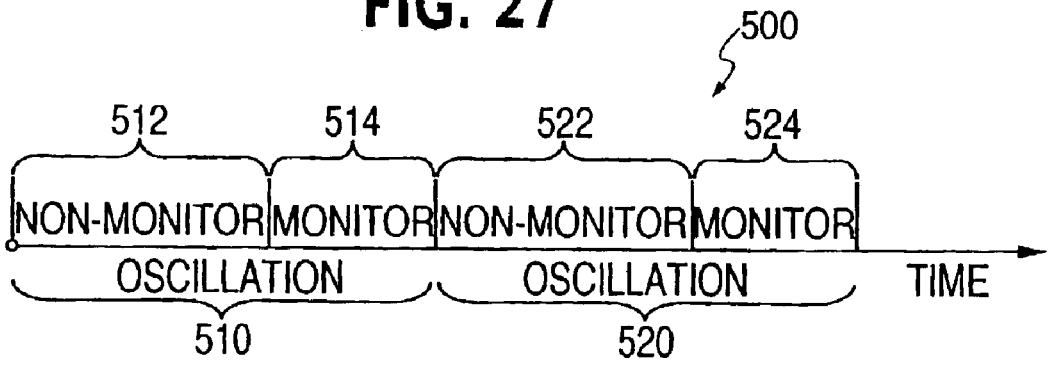
FIG. 27 illustrates a timeline depicting the method of operating the infant swing of FIG. 26.

An exemplary embodiment of oscillation cycles of the infant swing in the sonic mode according to the invention is illustrated in FIG. 27. FIG. 27 illustrates two oscillation cycles of the infant swing 5. A first oscillation cycle is represented by time period 510. The seat 30 oscillates continuously during time period 510, unless the power to the swing 5 is turned off by the user.

In the illustrated embodiment, the first time period 510 includes a non-monitor period 512 and a monitor period 514. During the non-monitor period 512, the sound detection circuit is not activated. During the monitor period 514, the sound detecting circuit is activated and monitors for audio inputs. In this embodiment, the non-monitor period 512 is approximately seventeen minutes and the monitor period 514 is approximately three minutes. In alternative embodiments, the lengths of the non-monitor period and the monitor period may be varied, depending on the amount of time over which sounds are to be detected.

A second oscillation cycle is represented by time period 520, which includes a non-monitor period 522 and a monitor period 524 as illustrated in FIG. 27. The lengths of periods 522 and 524 are approximately the same as periods 512 and 514.

Figure 28:
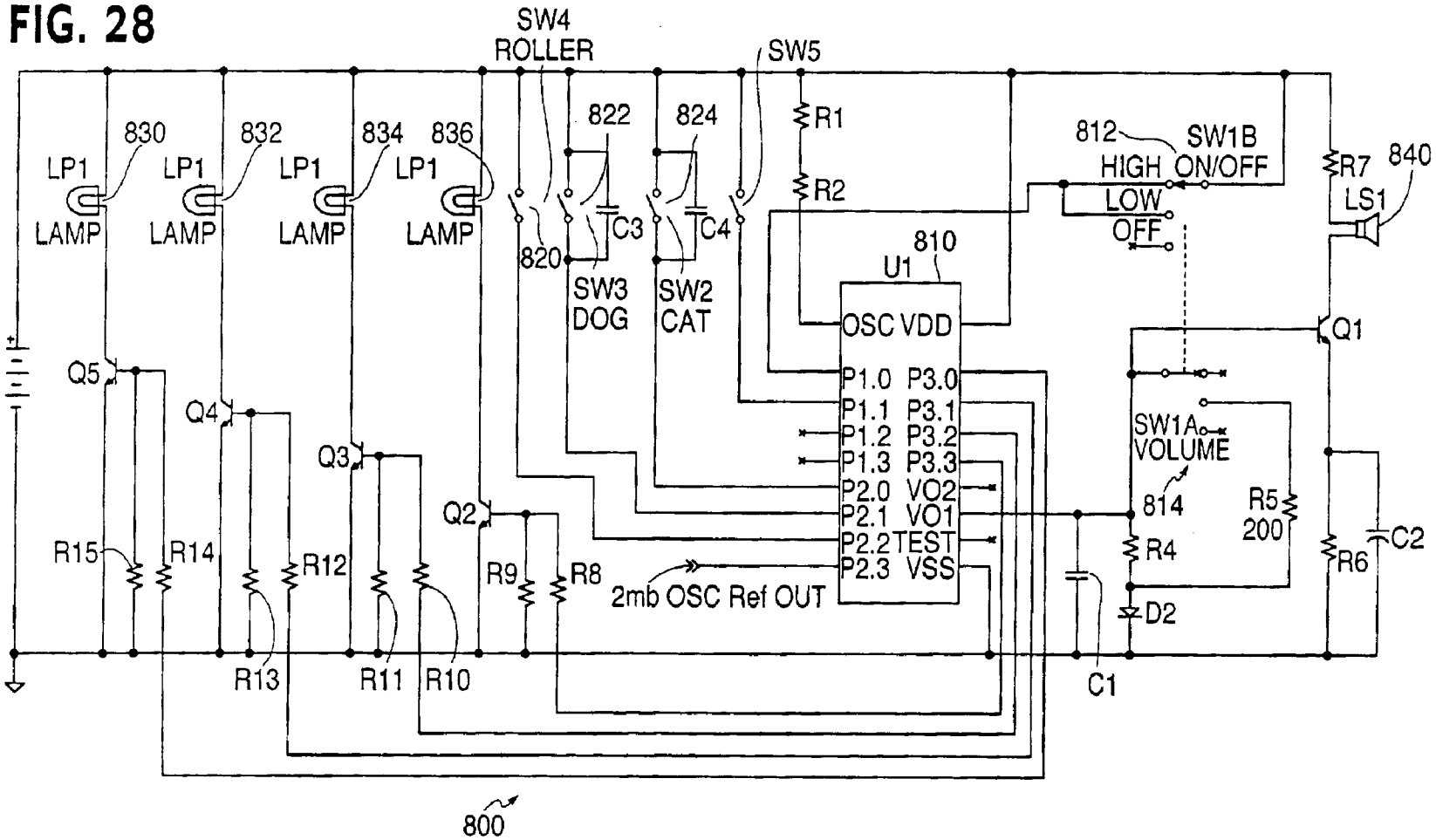
FIG. 28 illustrates a schematic diagram of an embodiment of an electronic circuit of the entertainment device according to the principles of the invention.

An embodiment of an electronic circuit of the entertainment device embodying the principles of the invention is illustrated in FIG. 28. FIG. 28 illustrates a schematic view of the electronic circuit 800. The electronic circuit 800 generates audio and visual outputs based on inputs from an infant in the seat 30 of the swing 5.

In the illustrated embodiment, electronic circuit 800 includes a controller or microprocessor 810. The circuit 800 includes a power switch 812 and a volume switch 814. The circuit 800 also includes several switches that are closed when an infant contacts parts of the entertainment device 400. In particular, circuit 800 includes a switch 820 associated with roller 430, an internal switch 822 for character 450, and an internal switch 824 for character 460. System 800 includes several lamps 830, 832, 834, and 836 that are illuminated in response to the closing of the corresponding switches on the entertainment device 400.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. An infant swing comprising:

a support;

a seat, said seat pivotally coupled to said support;

a drive mechanism, said drive mechanism coupled to said seat and adapted to impart motion to said seat for a first time period;

an audio input detector;

means for comparing audio input detected by said audio input detector relative to a predetermined amplitude level; and means for controlling said drive mechanism based upon whether said audio input exceeds said predetermined amplitude level for an entire duration of a predetermined second time period.

2. The infant swing of claim 1 wherein said audio input detector includes a sensor.

3. The infant swing of claim 1 wherein said drive mechanism includes a motor and said means for controlling includes a processor that controls said motor.

4. The infant swing of claim 1 further comprising:

means for determining the back EMF of said motor, said processor analyzing said back EMF to determine a load on said motor.

5. The infant swing of claim 4 wherein said processor causes said motor to impart motion to said seat for a fourth time period if said audio input exceeds said predetermined amplitude level.

6. The infant swing of claim 5 wherein said means for controlling utilizes pulse-width modulation to control said motor.

7. The infant swing of claim 1 wherein said second time period occurs after a third time period has elapsed.

8. An infant swing comprising:

a frame;

a seat, said seat coupled to said frame;

a drive mechanism coupled to said seat, said drive mechanism adapted to impart motion to said seat for a first time period;

a sensor, said sensor adapted to detect an audio input during a predetermined second time period; and a processor, said processor connected to said drive mechanism and said sensor, said processor adapted to cause said drive mechanism to impart motion to said seat after said first time period in response to the detection of said audio input by said sensor for an entire duration of said predetermined second time period.

9. The infant swing of claim 8 wherein said first time period is approximately equal to a sum of said second time period and said third time period.

10. The infant swing of claim 8 wherein said drive mechanism includes a motor, said processor determining a load on said motor and controlling said motor based on said load.

11. The infant swing of claim 8 wherein said predetermined second time period occurs after a third time period has elapsed.

* * * * *